US008016725B2

(12) United States Patent
Kissel et al.

(10) Patent No.: US 8,016,725 B2
(45) Date of Patent: Sep. 13, 2011

(54) VARIABLE RESISTANCE SYSTEM

(75) Inventors: Robert M. Kissel, Lithia, FL (US); Edward G. Eubanks, St. Peters, MO (US); James M. Houston, Evergreen, CO (US); Scott A. Dye, Morrison, CO (US); Dale A. Schoonover, Louisville, CO (US); Michael R. Cottrell, Arvada, CO (US)

(73) Assignee: Exertron, LLC, St. Louis, MO (US)

( * ) Notice: Subject to any disclaimer, the term of this patent is extended or adjusted under 35 U.S.C. 154(b) by 393 days.

(21) Appl. No.: 11/856,880

(22) Filed: Sep. 18, 2007

(65) Prior Publication Data

US 2009/0075791 A1 Mar. 19, 2009

Related U.S. Application Data

(63) Continuation-in-part of application No. 10/688,251, filed on Oct. 17, 2003, now abandoned.

(51) Int. Cl.
*A63B 21/005* (2006.01)
*A63B 21/06* (2006.01)

(52) U.S. Cl. ..... 482/5; 482/93

(58) Field of Classification Search ..... 482/4, 5, 482/8, 9, 93, 98, 99
See application file for complete search history.

(56) References Cited

U.S. PATENT DOCUMENTS 4,746,113 A 5/1988 Kissel
4,811,946 A * 3/1989 Pelczar ..... 482/5
4,822,034 A 4/1989 Shields
4,834,365 A 5/1989 Jones
4,836,536 A 6/1989 Jones
4,911,435 A 3/1990 Johns
4,921,244 A 5/1990 Berroth
4,971,305 A 11/1990 Rennex
5,037,089 A * 8/1991 Spagnuolo et al. ..... 482/5
5,100,128 A 3/1992 Mabry
5,314,394 A 5/1994 Ronan
5,328,429 A * 7/1994 Potash et al. ..... 482/99
5,350,344 A * 9/1994 Kissel ..... 482/98
5,407,403 A 4/1995 Coleman
5,431,609 A * 7/1995 Panagiotopoulos et al. ..... 482/5
5,556,362 A 9/1996 Whipps
5,643,151 A 7/1997 Naimo
5,655,997 A 8/1997 Greenberg
5,785,632 A * 7/1998 Greenberg et al. ..... 482/5
5,993,356 A 11/1999 Houston
6,015,367 A * 1/2000 Scaramucci ..... 482/5
6,045,491 A 4/2000 McNergney
6,117,049 A * 9/2000 Lowe ..... 482/4
6,174,265 B1 1/2001 Alessandri
6,224,519 B1 * 5/2001 Doolittle ..... 482/98
6,436,058 B1 8/2002 Krahner
(Continued)

*Primary Examiner* — Allana Lewin
(74) *Attorney, Agent, or Firm* — CreatiVenture Law, LLC; Dennis J M Donahue, III

(57) ABSTRACT

A method and apparatus for providing variable resistance in connection with exercise equipment uses multiple weight plates that are selected by selector assemblies. A series of actuators that are not directly connected to the selector assemblies actuate the selector assemblies to engage and disengage the weight plates. The actuators are in communication with a controller, which is connected to a user interface console. The user interface console accepts input from a user and instructs the controller to adjust the amount of weight engaged by the selector assemblies based on input from the user and various sensors.

25 Claims, 21 Drawing Sheets

U.S. PATENT DOCUMENTS 6,468,189 B2 10/2002 Allessandri
6,494,811 B1 12/2002 Alessandri
6,582,345 B2 6/2003 Roy
6,626,805 B1 9/2003 Lightbody
6,632,159 B1 10/2003 Slattery
6,632,161 B1 * 10/2003 Nir ..... 482/98
7,011,611 B1 3/2006 Ripley
7,077,791 B2 7/2006 Krull
7,485,076 B2 * 2/2009 Lee ..... 482/99
7,534,199 B2 5/2009 Krull
7,553,265 B2 6/2009 Crawford et al.
7,614,982 B2 11/2009 Crawford
7,794,373 B2 9/2010 Crawford

* cited by examiner

VARIABLE RESISTANCE SYSTEM

CROSS-REFERENCE TO RELATED APPLICATIONS

This application is a continuation-in-part of U.S. Ser. No. 10/688,251 now abandoned which was filed on Oct. 17, 2003.

STATEMENT REGARDING FEDERALLY SPONSORED RESEARCH

Not Applicable.

APPENDIX

Not Applicable.

BACKGROUND OF THE INVENTION

1. Field of the Invention

The present invention relates to variable resistance systems, and more particularly, to an automatically adjustable system that is useful in providing variable resistance in exercise equipment.

2. Related Art

It is known that, for maximum benefit, an athlete in training must push himself to his maximum strength limits. This is difficult to achieve with conventional weight training equipment such as a bench press machine or other general purpose or special purpose machines since generally the athlete has heretofore stopped exercising when he reaches his first point of momentary muscular failure (MMF). At that point, the athlete must either personally change the weight on the machine he is using, or a second person must change the weight for him so that the athlete can continue using the machine. This either unnecessarily interrupts the exercise, or requires the continual presence of a second, non-exercising partner. If the athlete were able to experience multiple MMF's during any one set of specific exercise, he would eventually reach his absolute fatigue point (AFP). However, with conventional exercise equipment, the AFP is extremely difficult or impossible to reach due to the drawbacks described above.

Consider the case of an athlete lifting 120 pounds while doing bench presses. In this exercise, direct resistance is placed upon pectoral major and anterior deltoids. Soon, for example after only ten complete repetitions, this athlete is no longer able to complete another repetition. As a direct result, he stops exercising, even though he would be able to continue exercising at a lower weight amount, and ultimately reach his AFP.

Weight stacks of conventional exercise machines generally include a number of identical weight plates, or optionally include some smaller weights of a second value at the top of a stack, or which can be manually connected to the weight stack. Changing the weight resistance automatically in such a system can be complicated and expensive. For example, one possible approach is to provide individual automatically actuable selector pins for each plate that can be chosen as needed to choose the desired weight for the stack at that point in the exercise. Alternatively, a movable pin or pins can travel along the weight stack to the desired position for selecting the proper resistance. An exercise machine described in coassigned U.S. patent application Ser. No. 10/688,251, the entire specification of which is hereby incorporated by reference, utilizes actuators to select vertically oriented weight plates by pressing a tang into a recess.

SUMMARY OF THE INVENTION

The present invention provides a variable resistance system for an exercise machine that permits and controls the automated changing of weight resistance without interrupting the exercise of the machine's user. In a preferred embodiment of the invention, the mechanism that selects the weights to be lifted is not in physical contact with the mechanism that actuates the selector mechanism. A system for providing variable resistance to exercise equipment has hooks that engage various weight plates. The hooks are actuated to engage or disengage such weight plates by using magnets, thereby avoiding direct physical contact between the selecting mechanism, which moves with the selected weight plates, and the actuating mechanism, which is electrically connected to a controller. In one embodiment a user interface console provides multiple options to a user and directs the controller to automatically cause the weight lifted to increase or decrease based on multiple factors.

Accordingly, in furtherance of the above advantages and goals, the invention is, briefly a variable resistance system comprising a resistance providing member, an actuator, and a selector assembly, wherein the actuator actuates the selector assembly to selectively engage or disengage the resistance providing member by applying a force on the selector assembly or by removing a force from the selector assembly. According to the invention, movement of the selector assembly is dissociated from the position of actuator.

Furthermore the invention provides for a method of providing variable resistance comprising the steps of providing a plurality of resistance providing members, defining a successful repetition as characterized by satisfying a criteria, selecting a first set of resistance providing members having a first total resistance, and selecting a second set of resistance providing members having a second total resistance after a repetition that does not satisfying the criteria, wherein the second total resistance is less than the first total resistance.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

Figure 5:
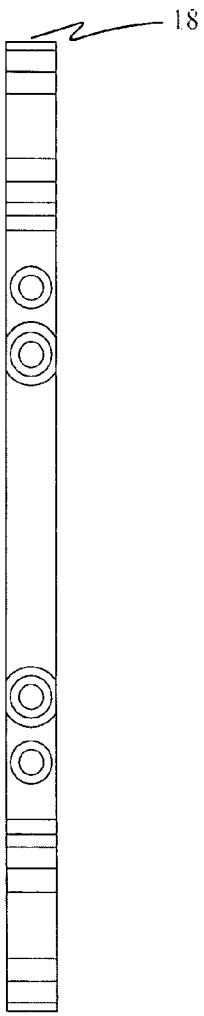
FIG. 5 is a top view of a weight hook of the variable resistance system of FIG. 1.

1, for engaging and lifting a weight of the system via a weight hook of the type illustrated in FIG. 5.

Figure 7B:
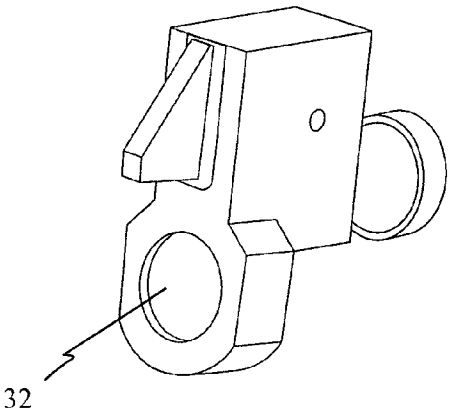
FIG. 7A is an exploded view of a weight selector hook assembly constructed in accordance with the system of FIG.
Figure 7A:
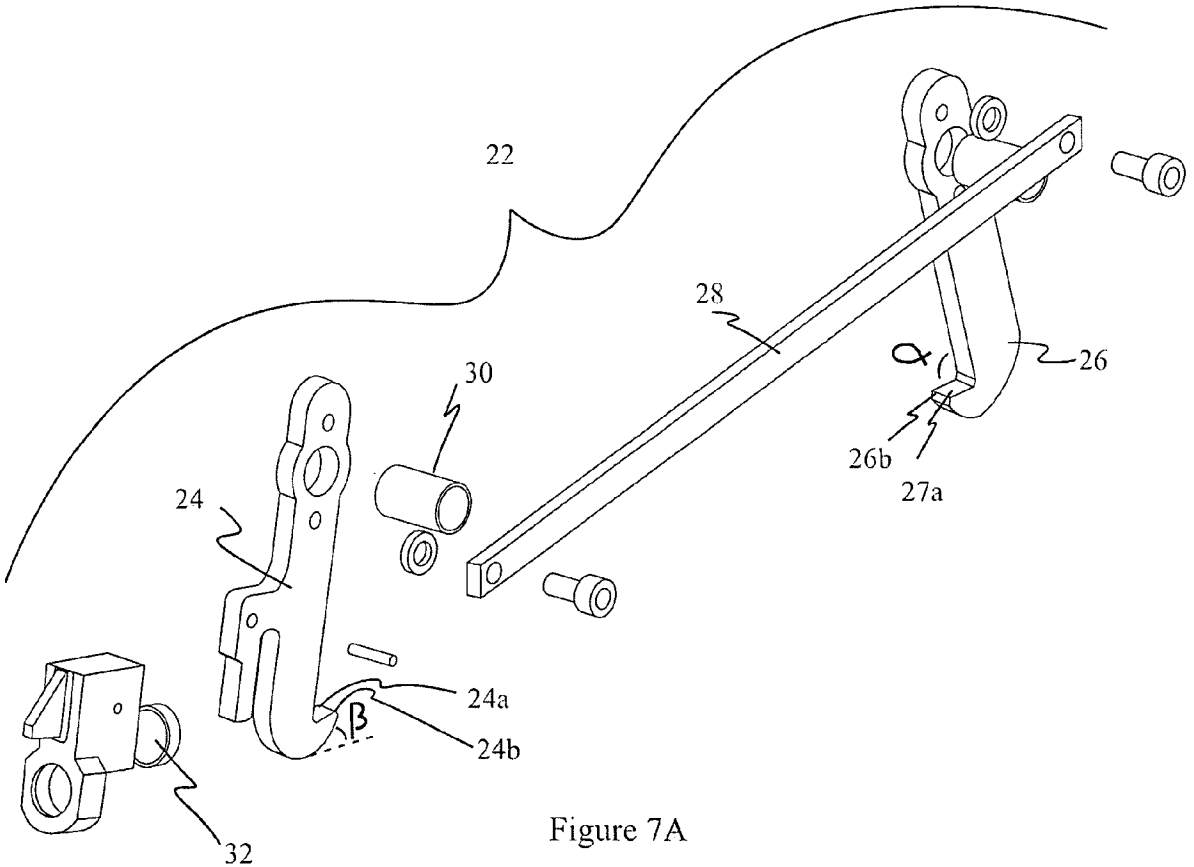

FIG. 7B is an enlarged view of the magnet portion of the weight selector hook assembly of FIG. 7A.

Figure 1:
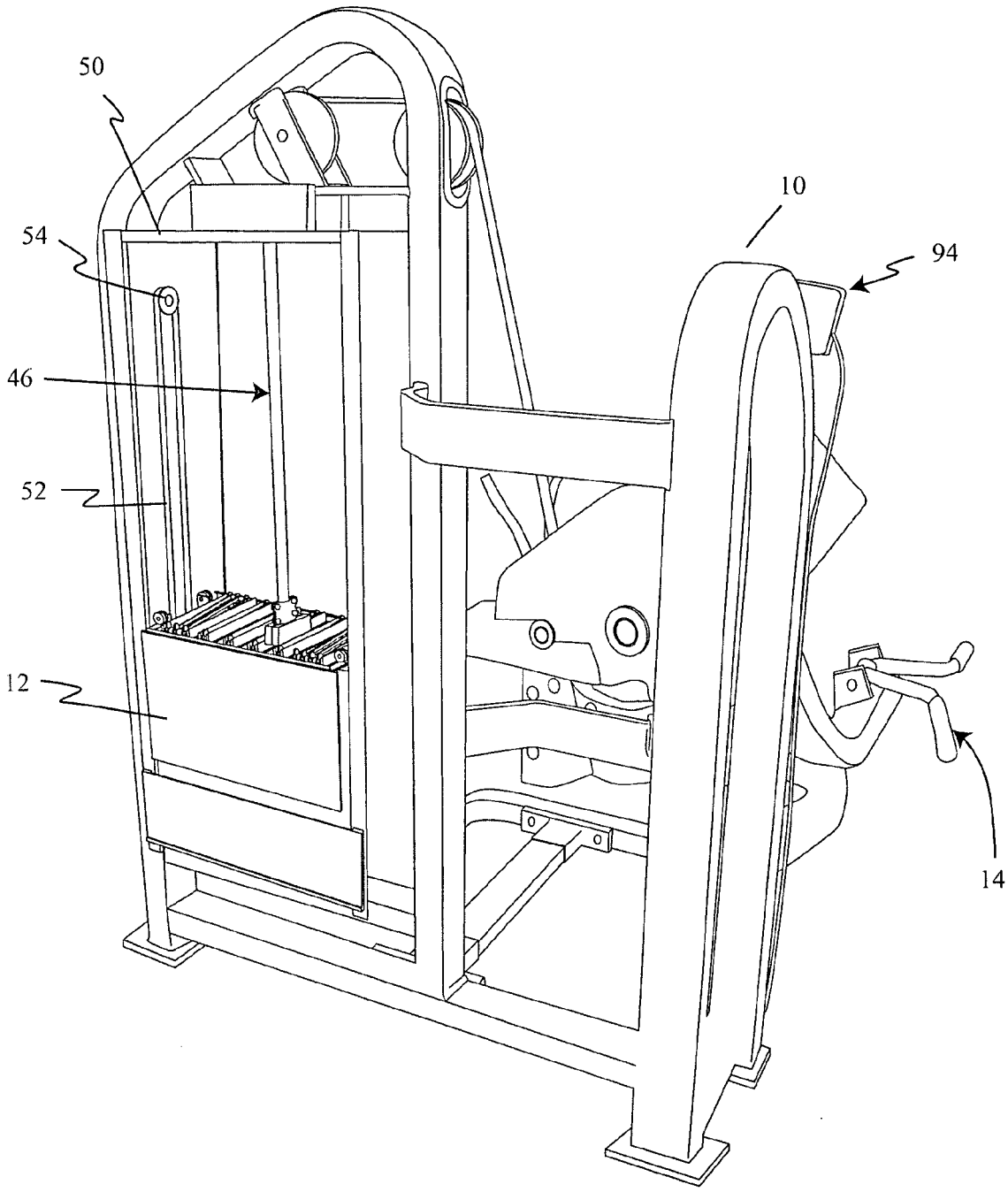
FIG. 1 is a back perspective view of an exercise machine having a variable resistance system constructed in accordance with the present invention.
Figure 8:
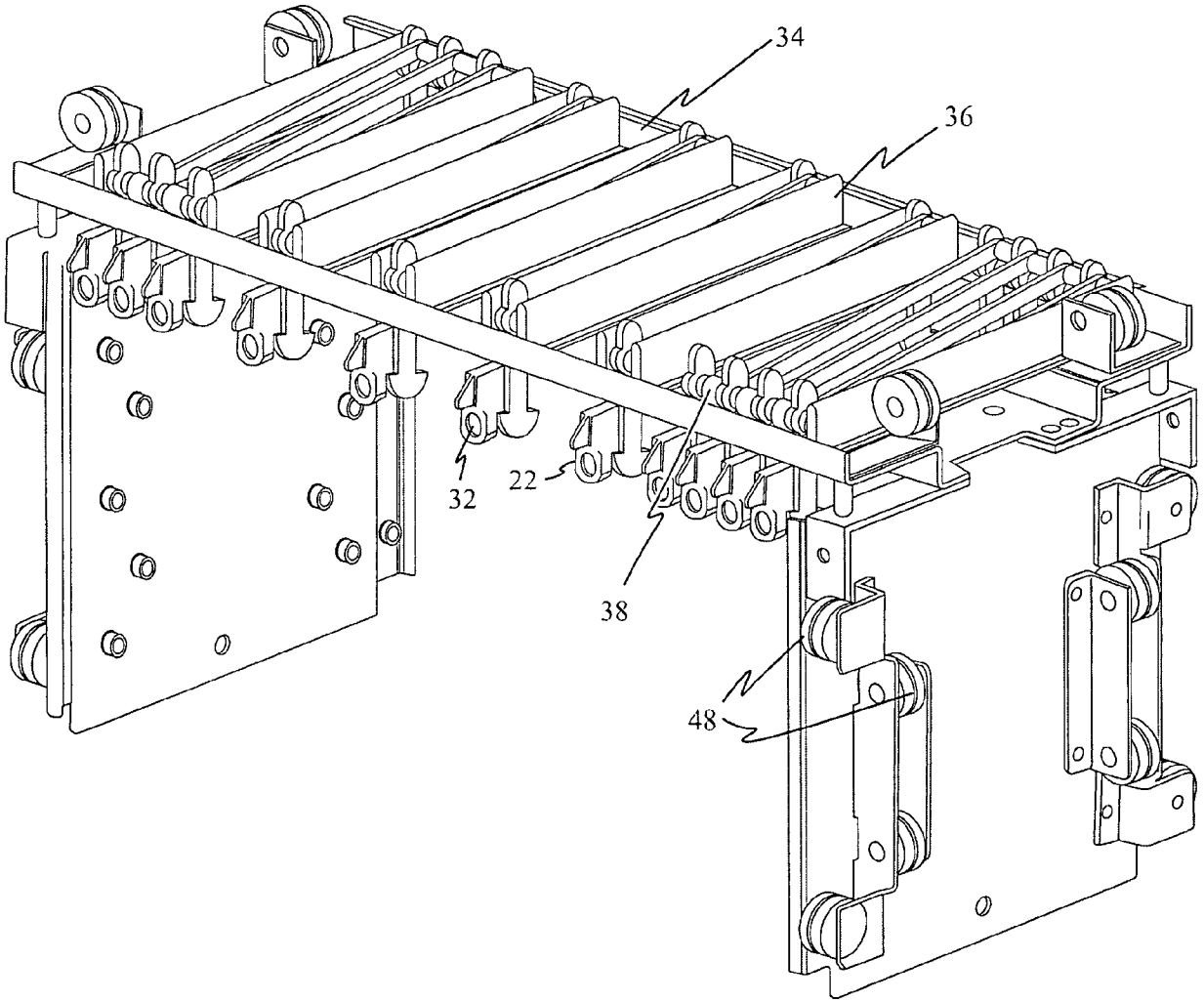

FIG. 8 is a perspective view of the weight selector assembly of the system of FIG. 1.

Figure 9:
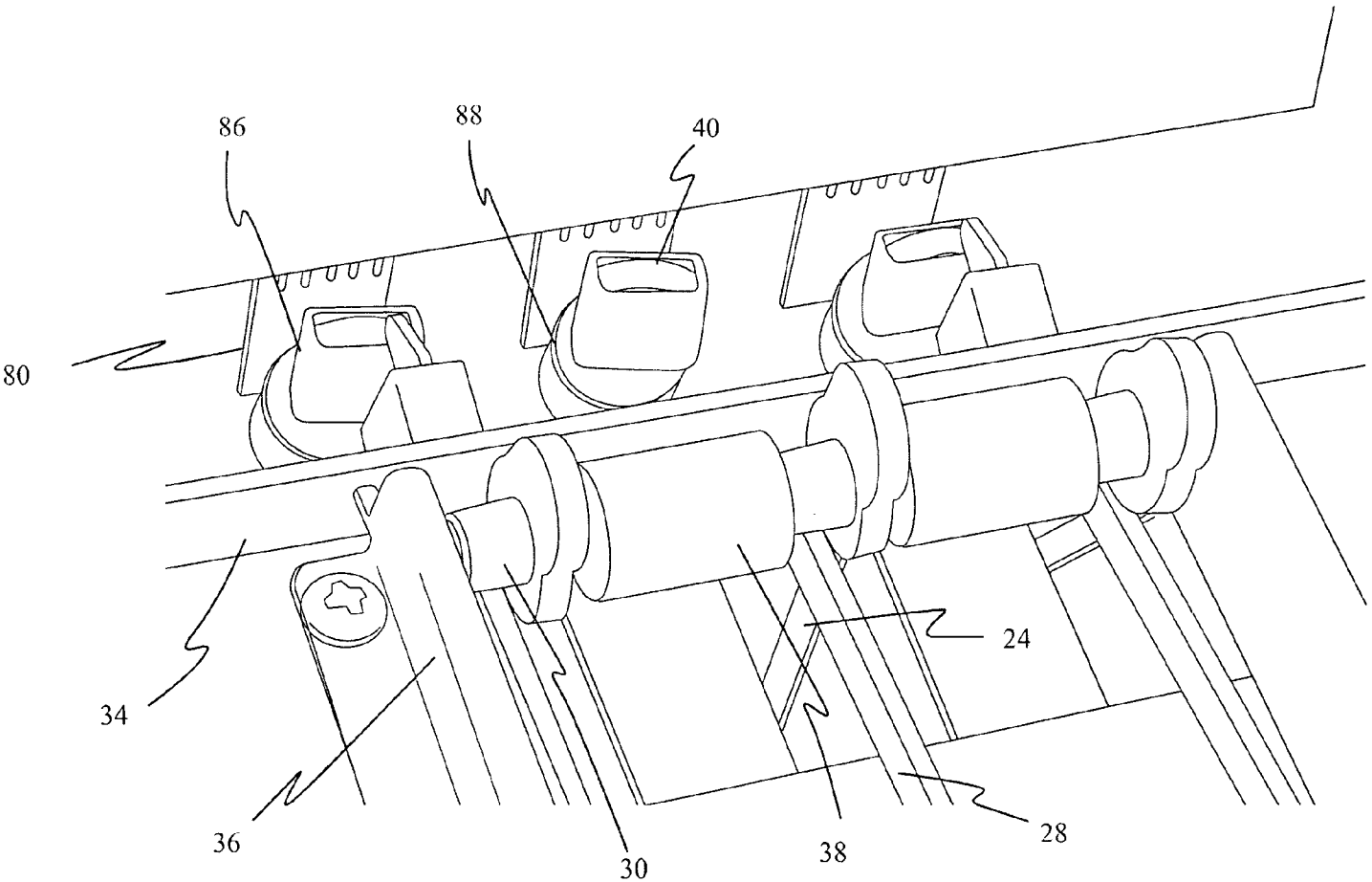

FIG. 9. is a partial, enlarged perspective view of a portion of the weight selector hook assembly of FIG. 8 in position within the housing of the system and showing a portion of the lift plate and actuators.

Figure 10:
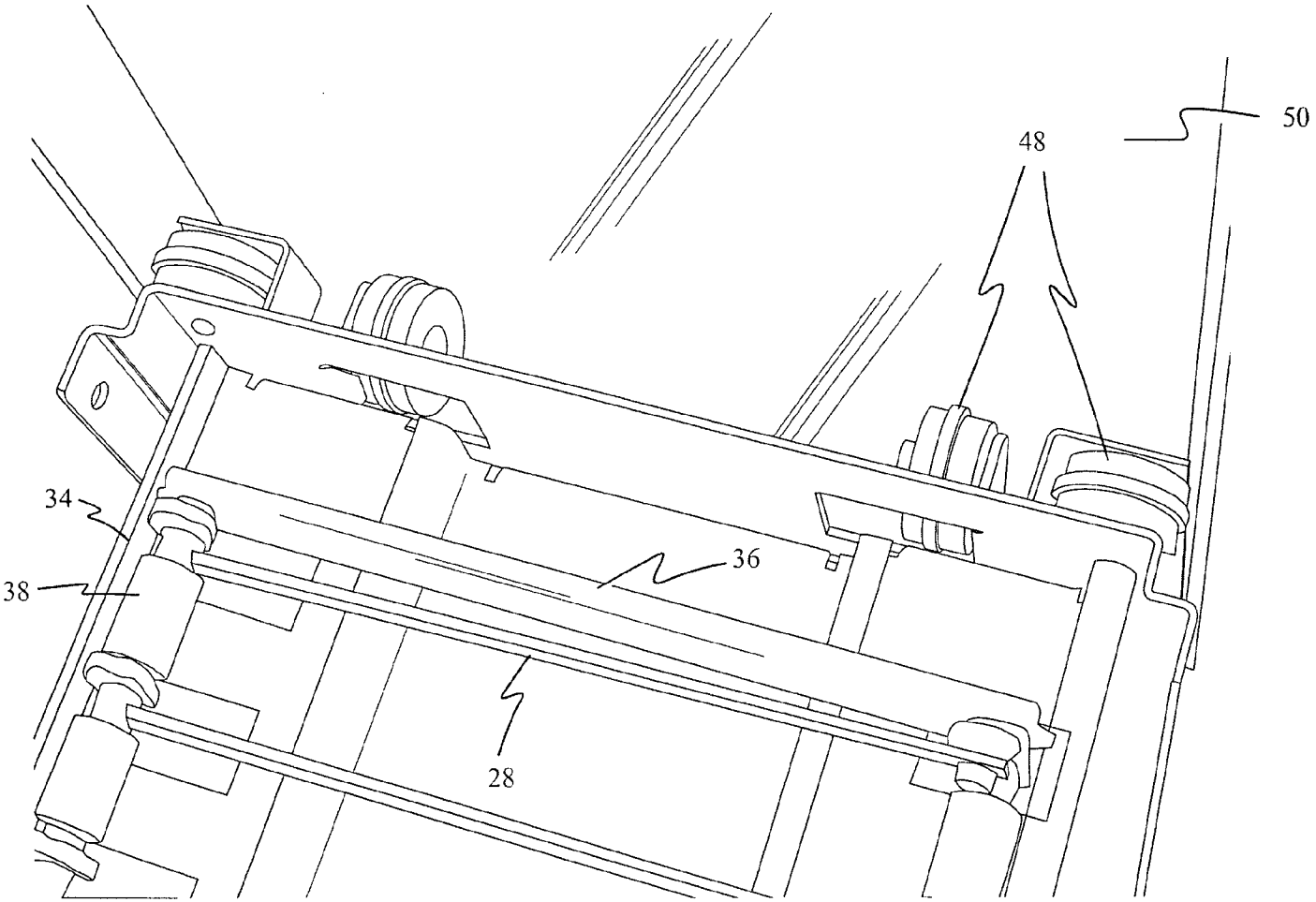

FIG. 10 is another partial, enlarged perspective view of the assembly of FIG. 8 at a different position within the housing of the system of FIG. 1.

Figure 11:
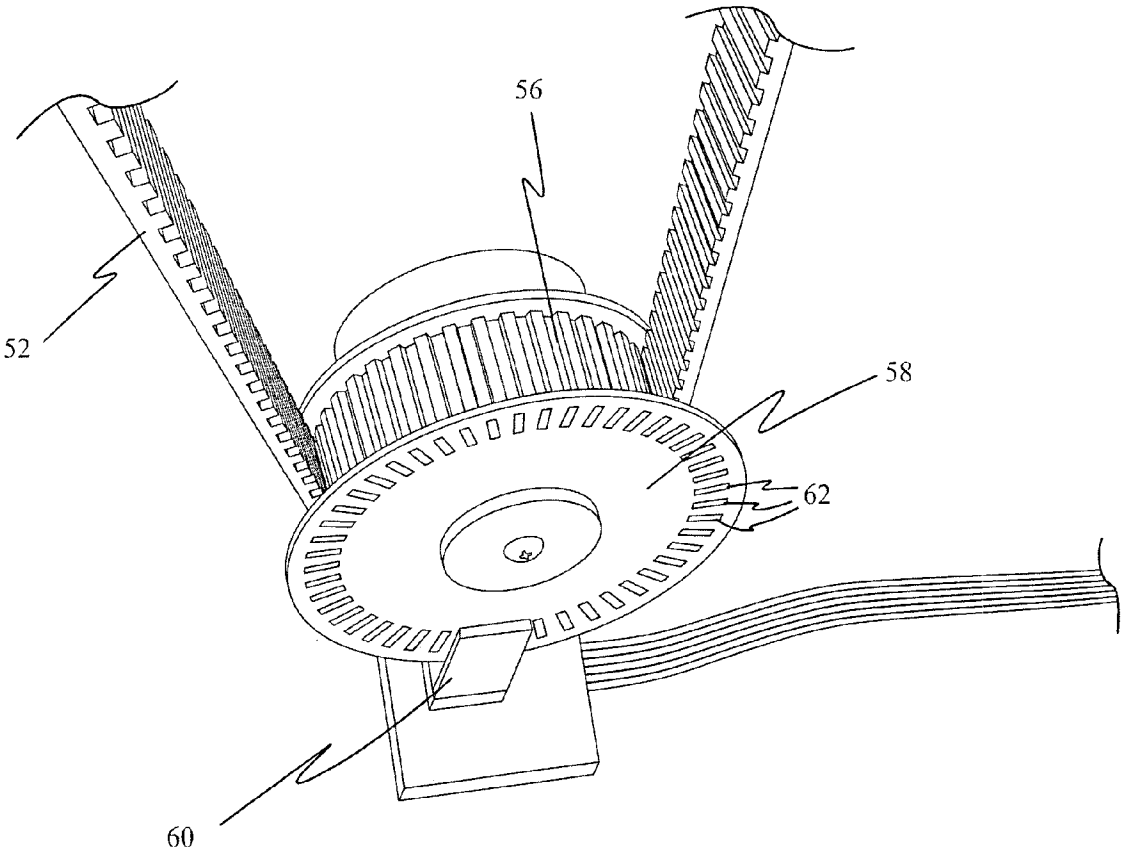

FIG. 11 is an enlarged perspective view of the optical sensor and slotted disk assembly of the system of FIG. 1.

Figure 12:
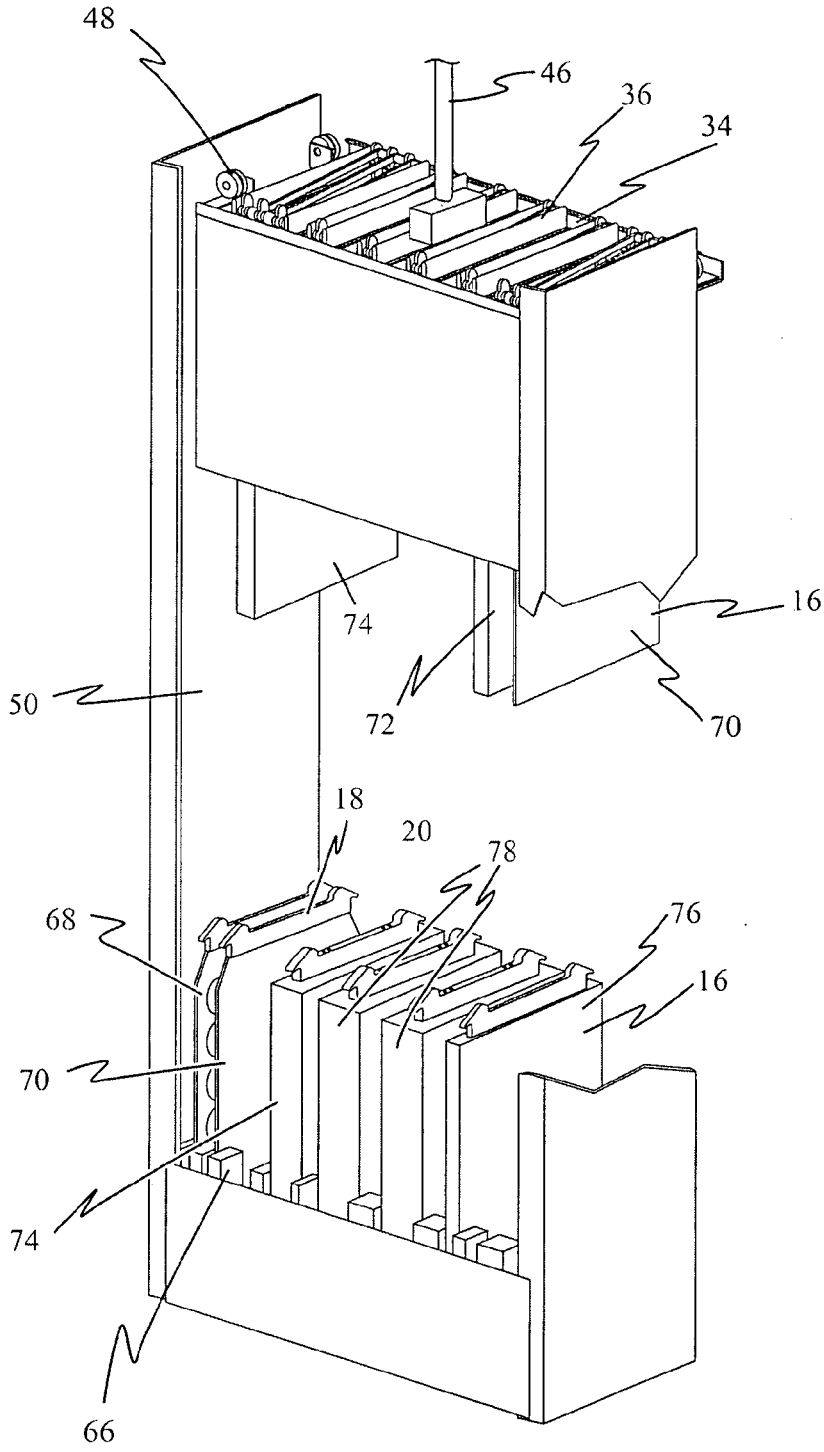

FIG. 12 is a rear elevational view of the machine of FIG. 1 with the rear plate of the housing removed to illustrate the weight stack with some weights selected and in the raised position.

Figure 13B:
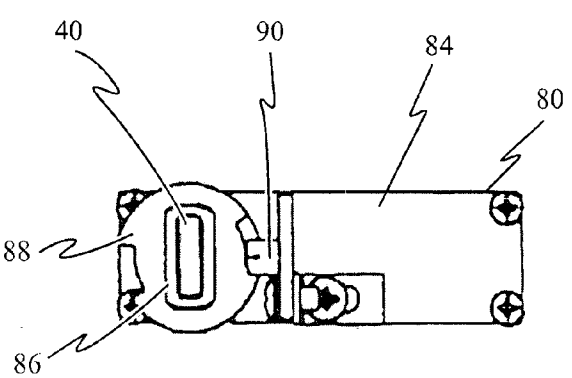
Figure 13C:
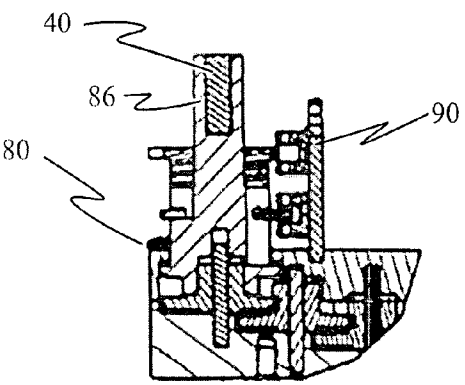
Figure 13A:
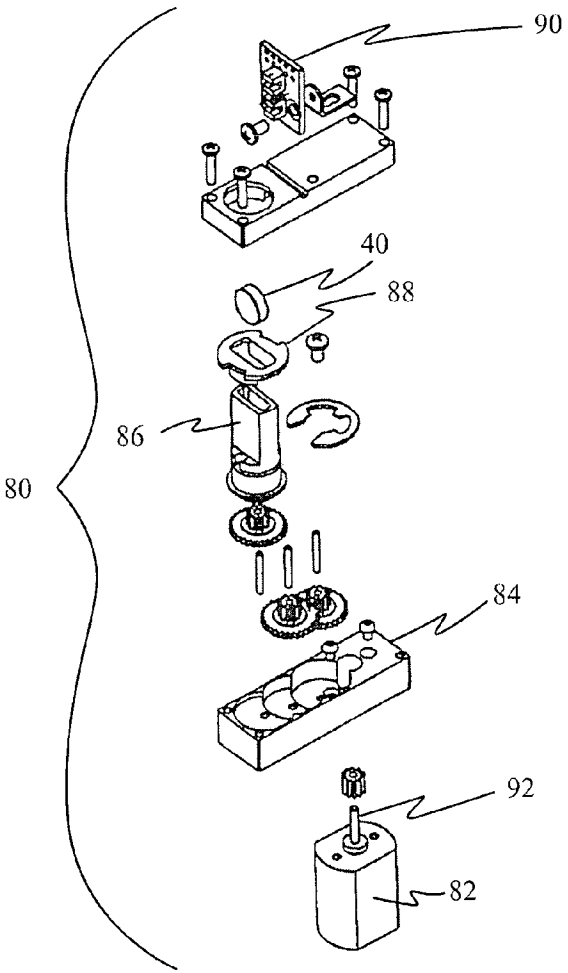

FIG. 13A is an exploded schematic view of the hook actuator assembly of the system of FIG. 1.

FIG. 13B is plan view of the hook actuator assembly of FIG. 13A in assembled position.

FIG. 13C is a sectional view of the hook actuator assembly of FIG. 13B.

Figure 14:
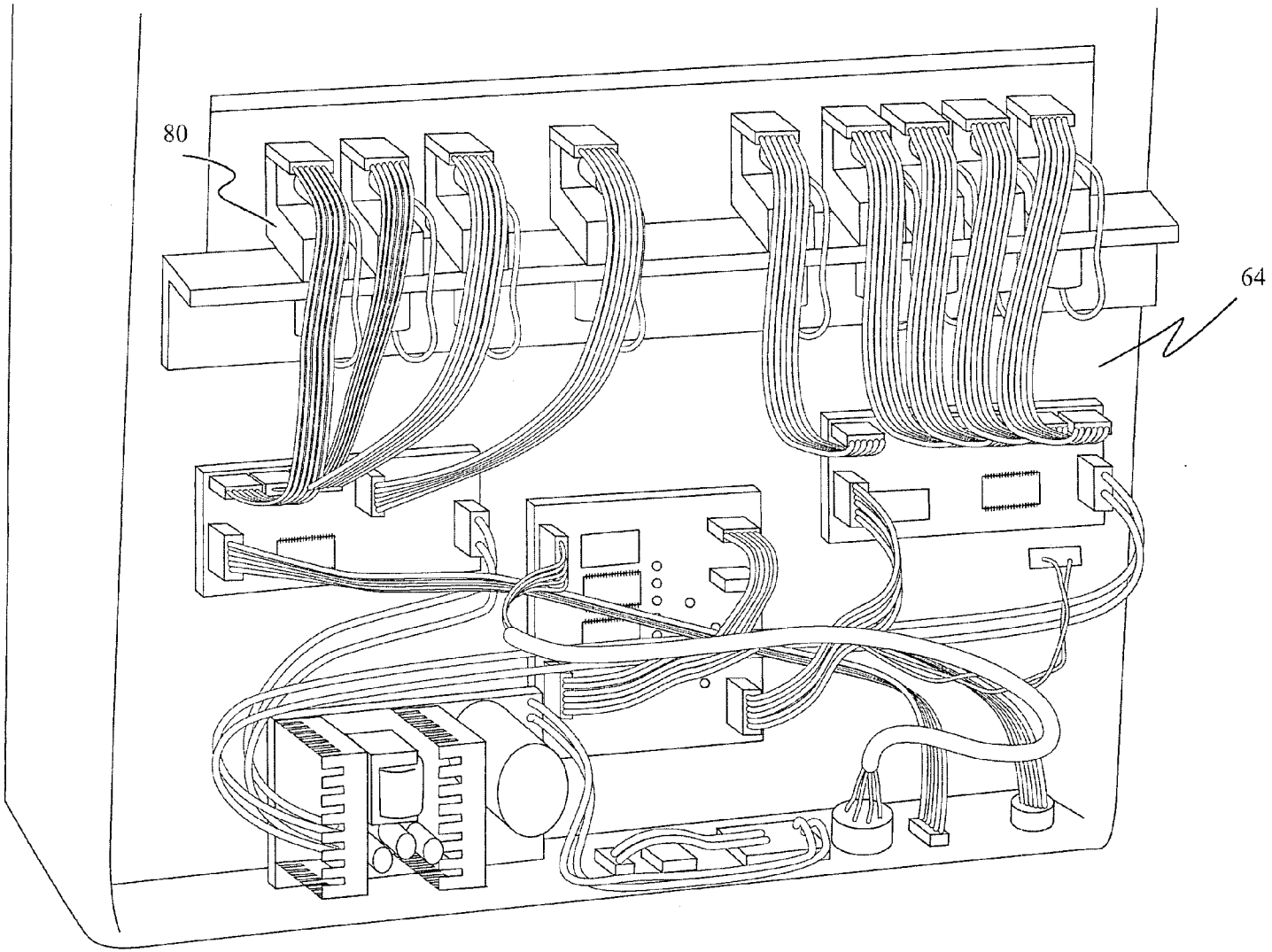

FIG. 14 is a front perspective view of the electronic control panel of the system of FIG. 1, with the protective panel removed.

Figure 15:
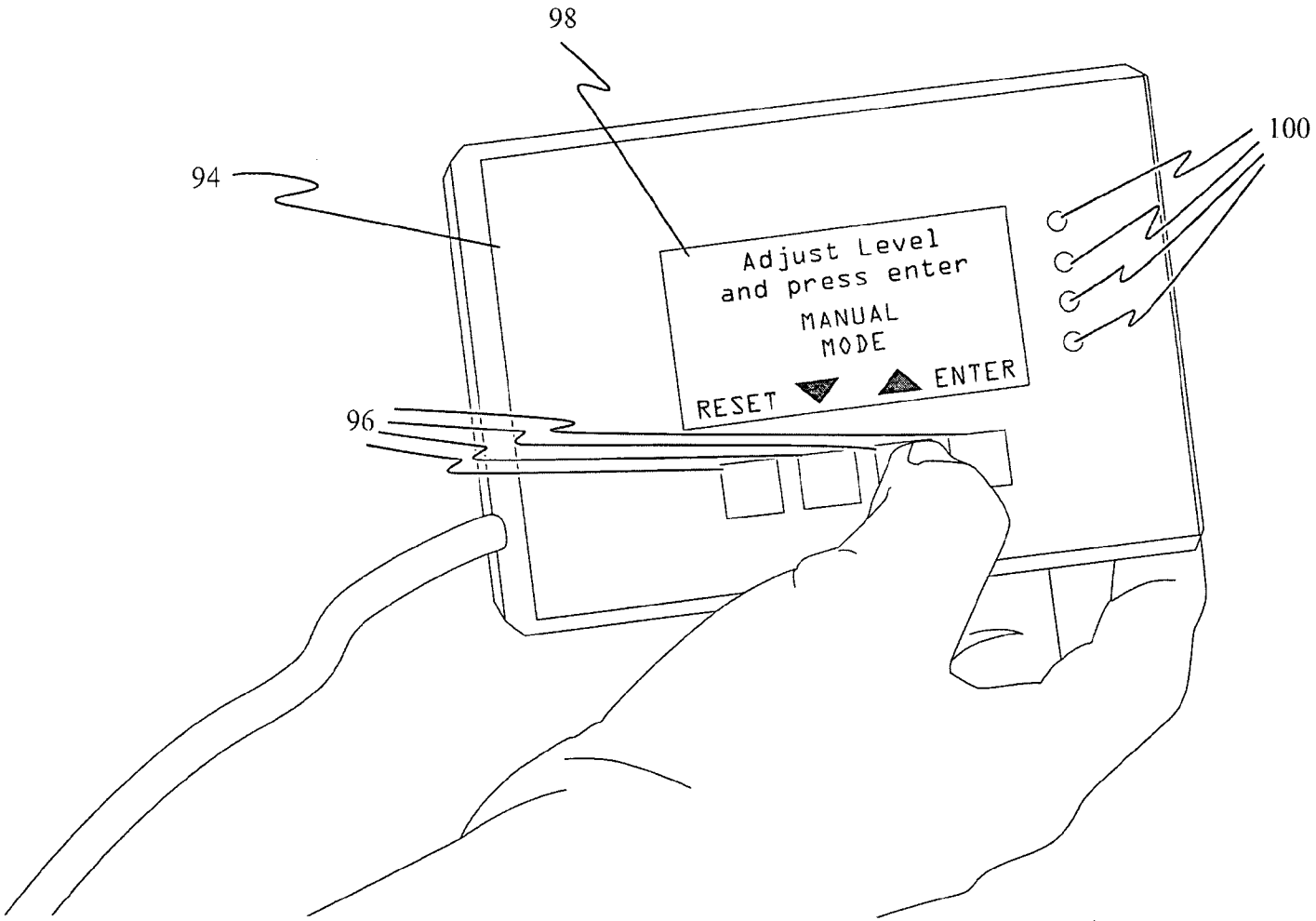

FIG. 15 is a perspective view of the user interface console of the system of FIG. 1.

Figure 16:
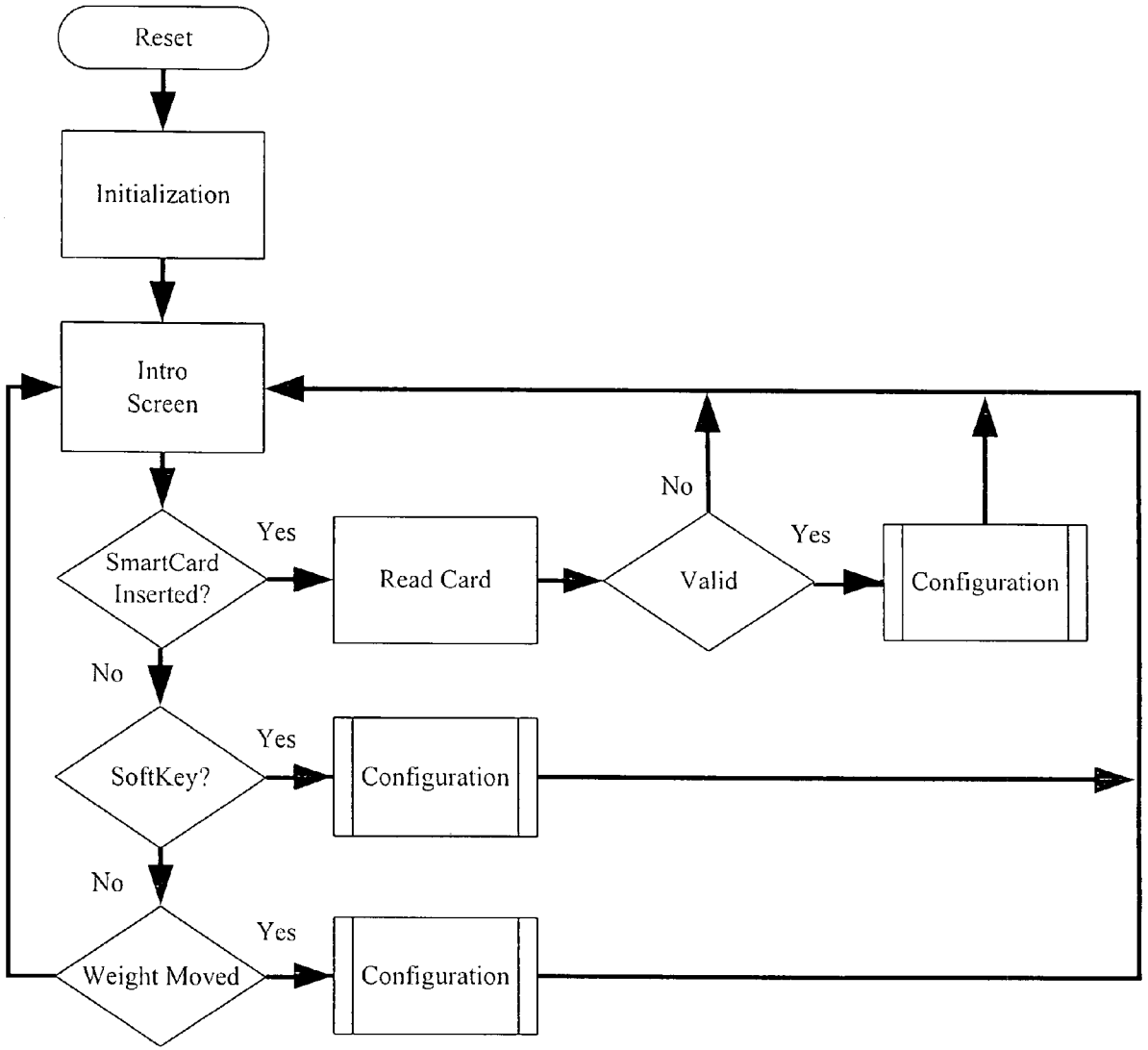

FIG. 16 is a flowchart illustrating logic at the introduction screen of a user interface console.

Figure 17:
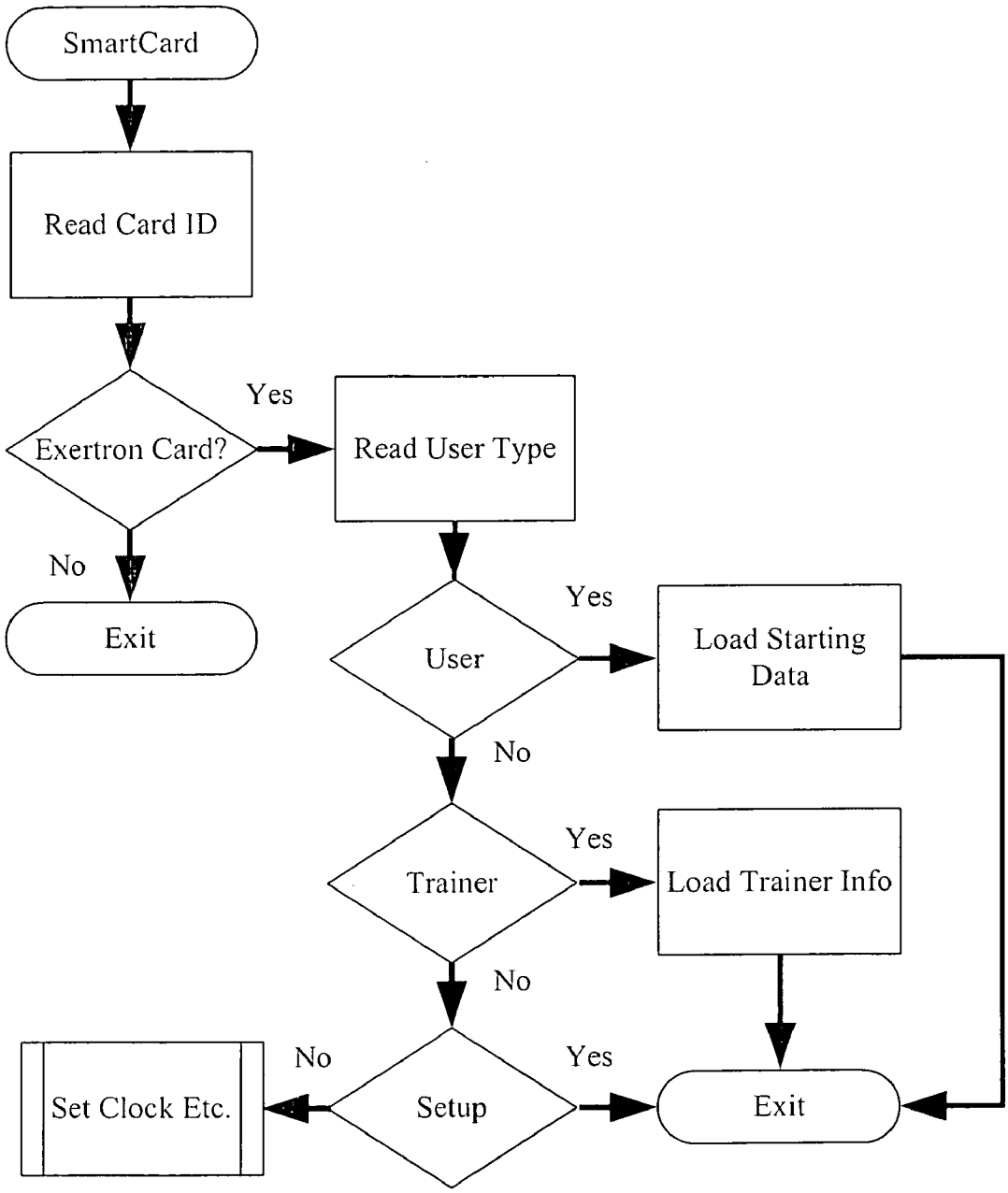

FIG. 17 is a flowchart illustrating logic used by a user interface console when reading a memory card.

Figure 18:
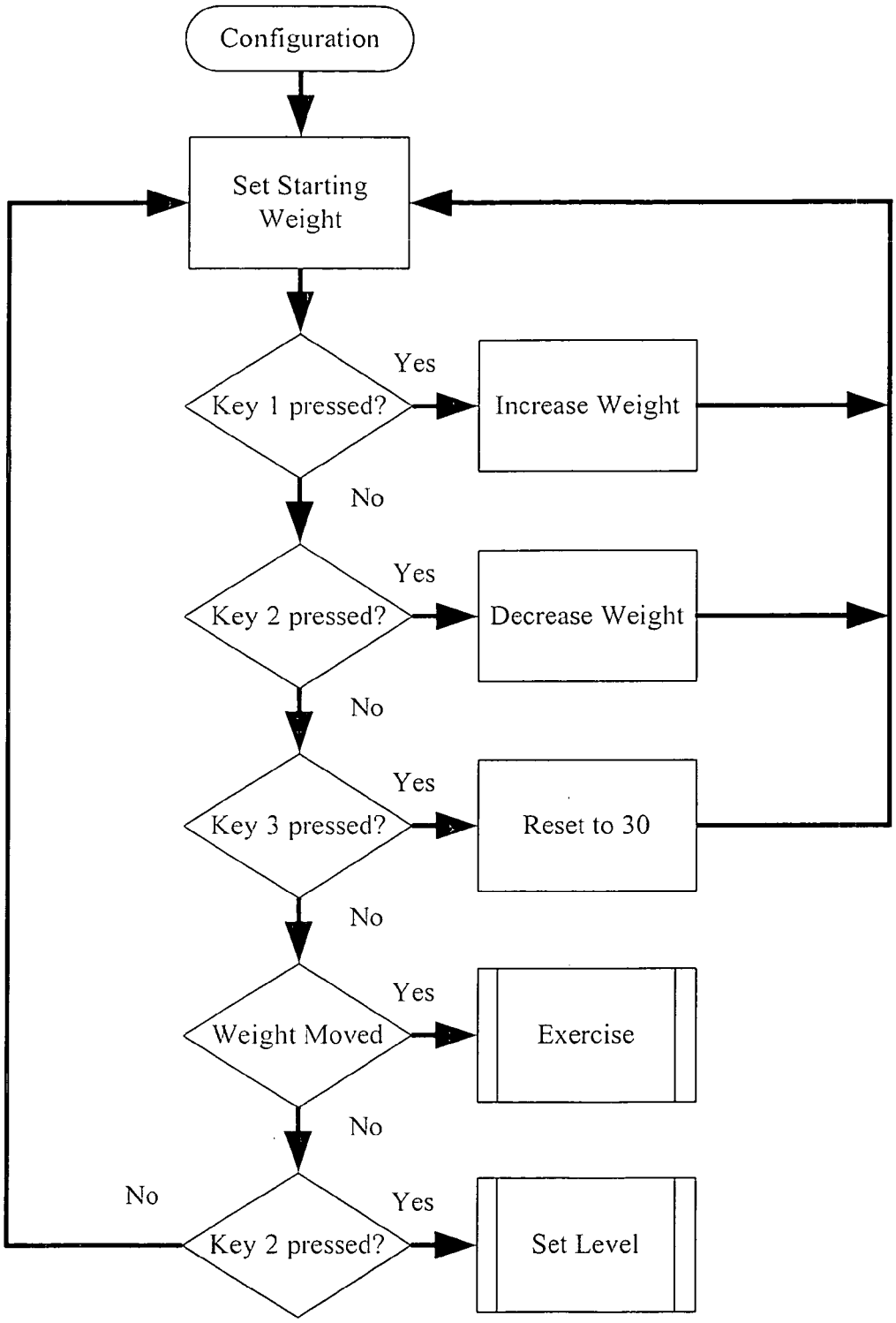

FIG. 18 is a flowchart illustrating logic used by a user interface console when configuring exercise parameters, particularly starting weight.

Figure 19:
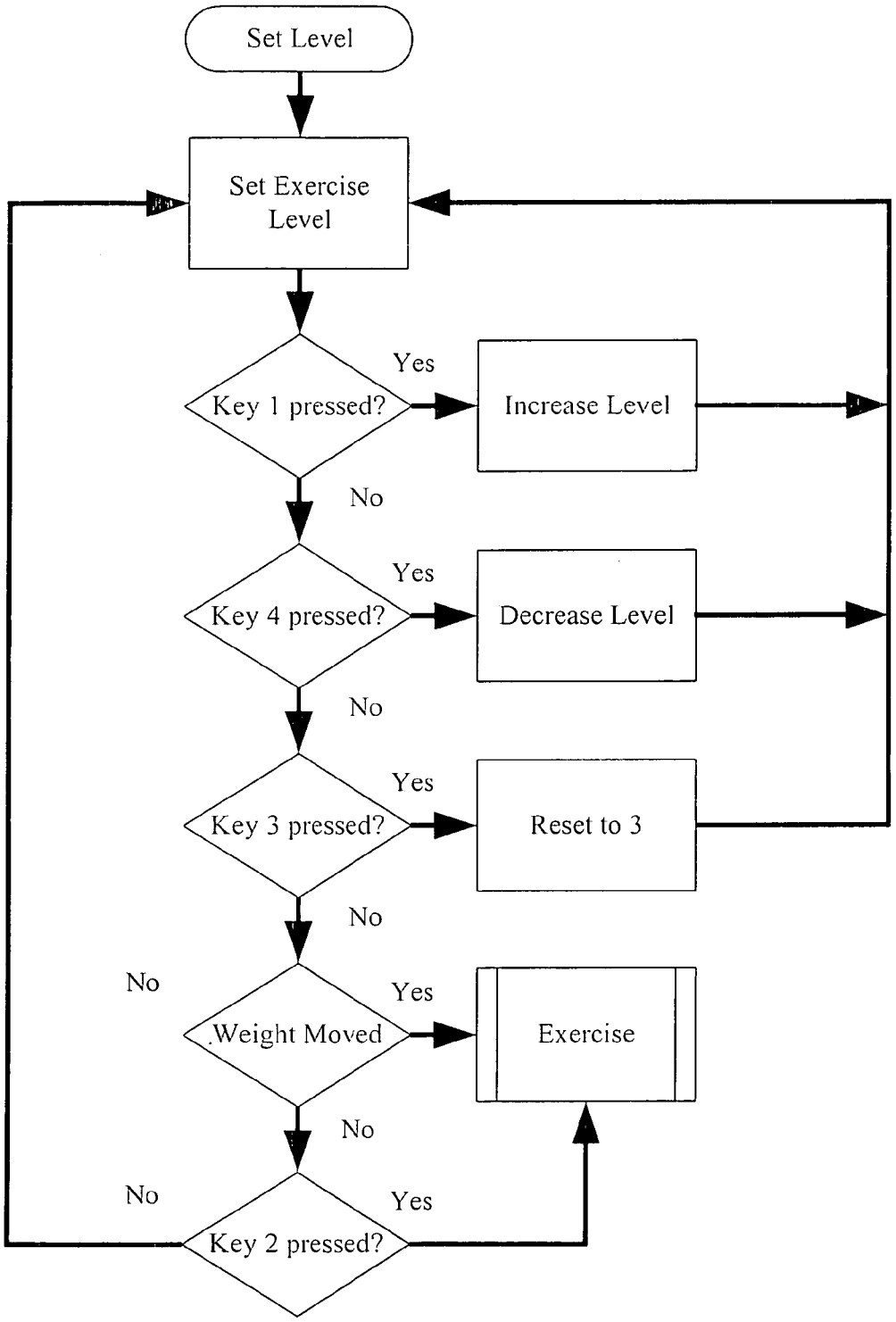

FIG. 19 is a flowchart illustrating logic used by a user interface console when configuring exercise parameters, particularly intensity level.

Figure 20:
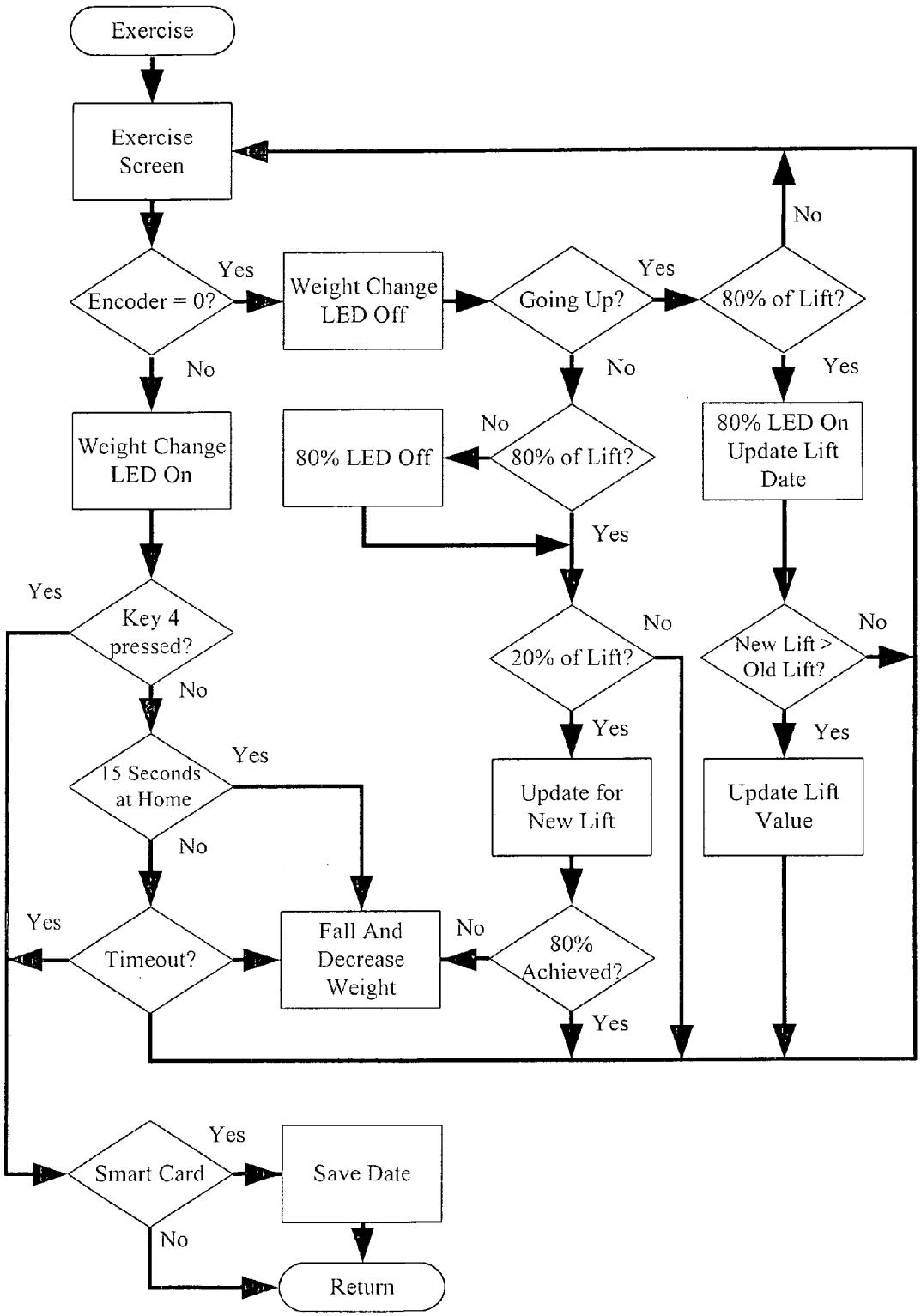

FIG. 20 is a flowchart illustrating logic used by a user interface console during exercise under an automatic weight change setting.

Figure 21:
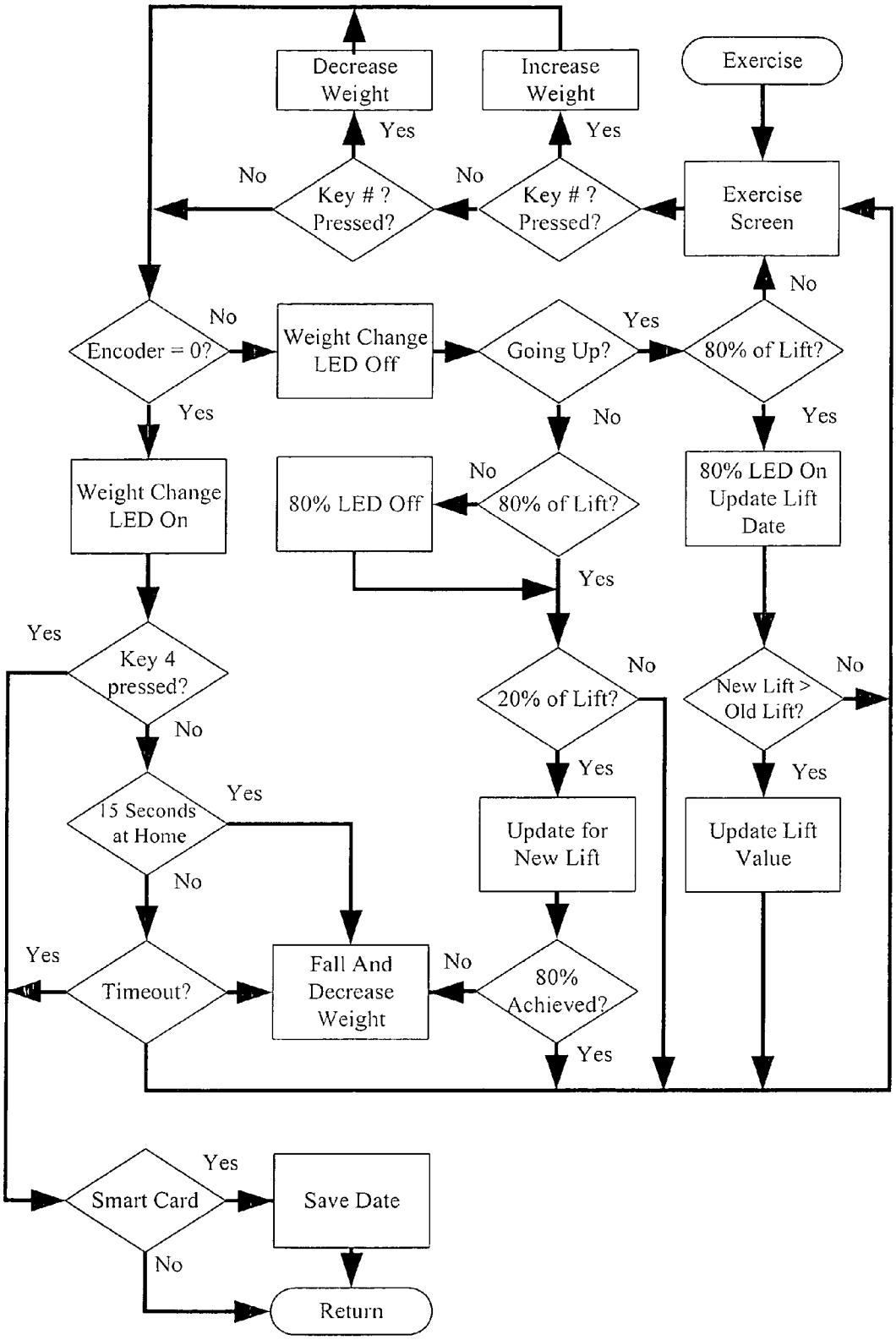

FIG. 21 is a flowchart illustrating logic used by a user interface console during exercise under a manual weight change setting.

Figure 22:
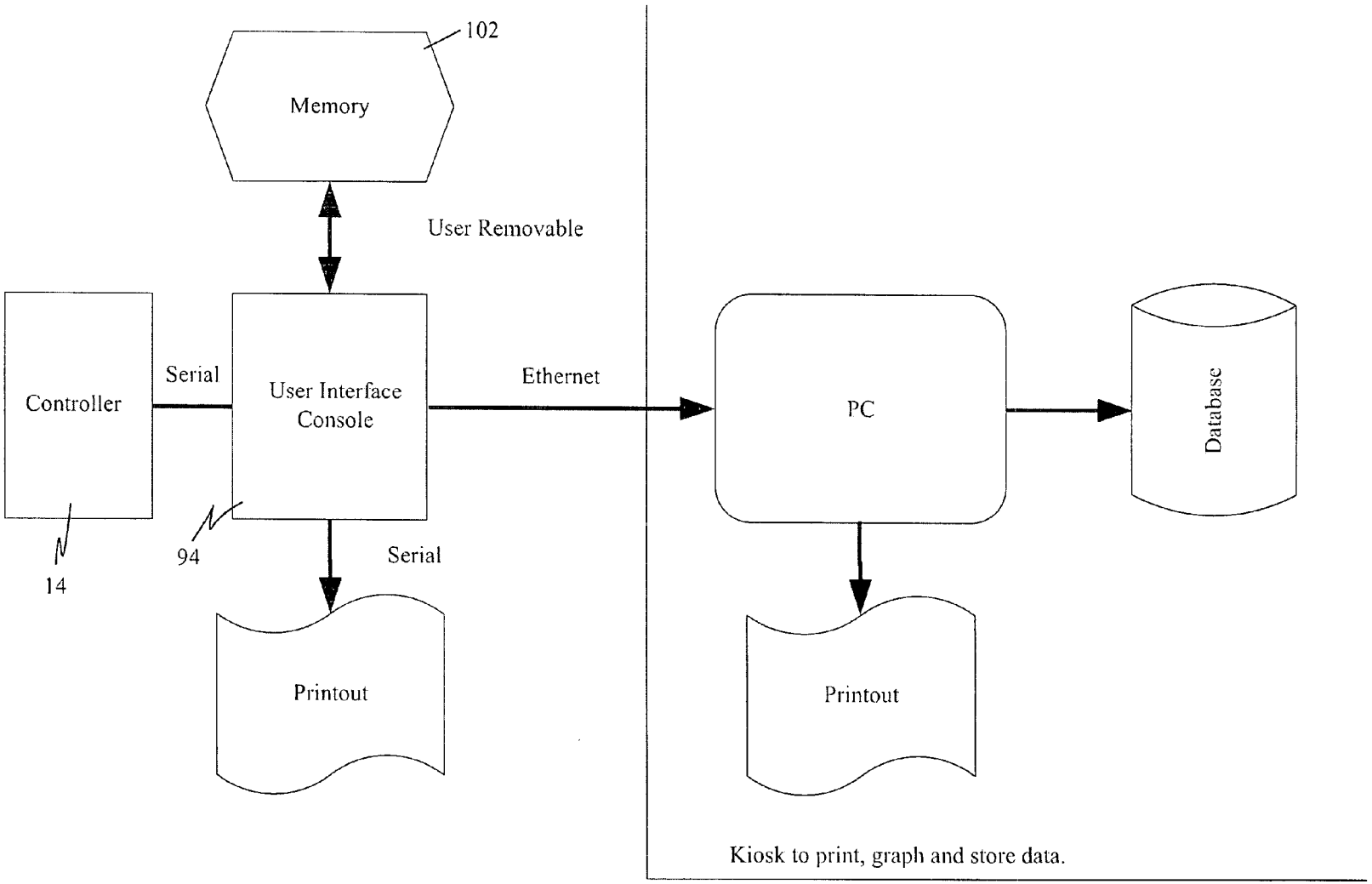

FIG. 22 is a diagram illustrating the connection of a user interface console with a computer and a database.

Throughout the figures like parts are indicated by like element numbers.

DETAILED DESCRIPTION OF THE PREFERRED EMBODIMENTS

The following description of the preferred embodiment(s) is merely exemplary in nature and is in no way intended to limit the invention, its application, or uses.

Figure 2:
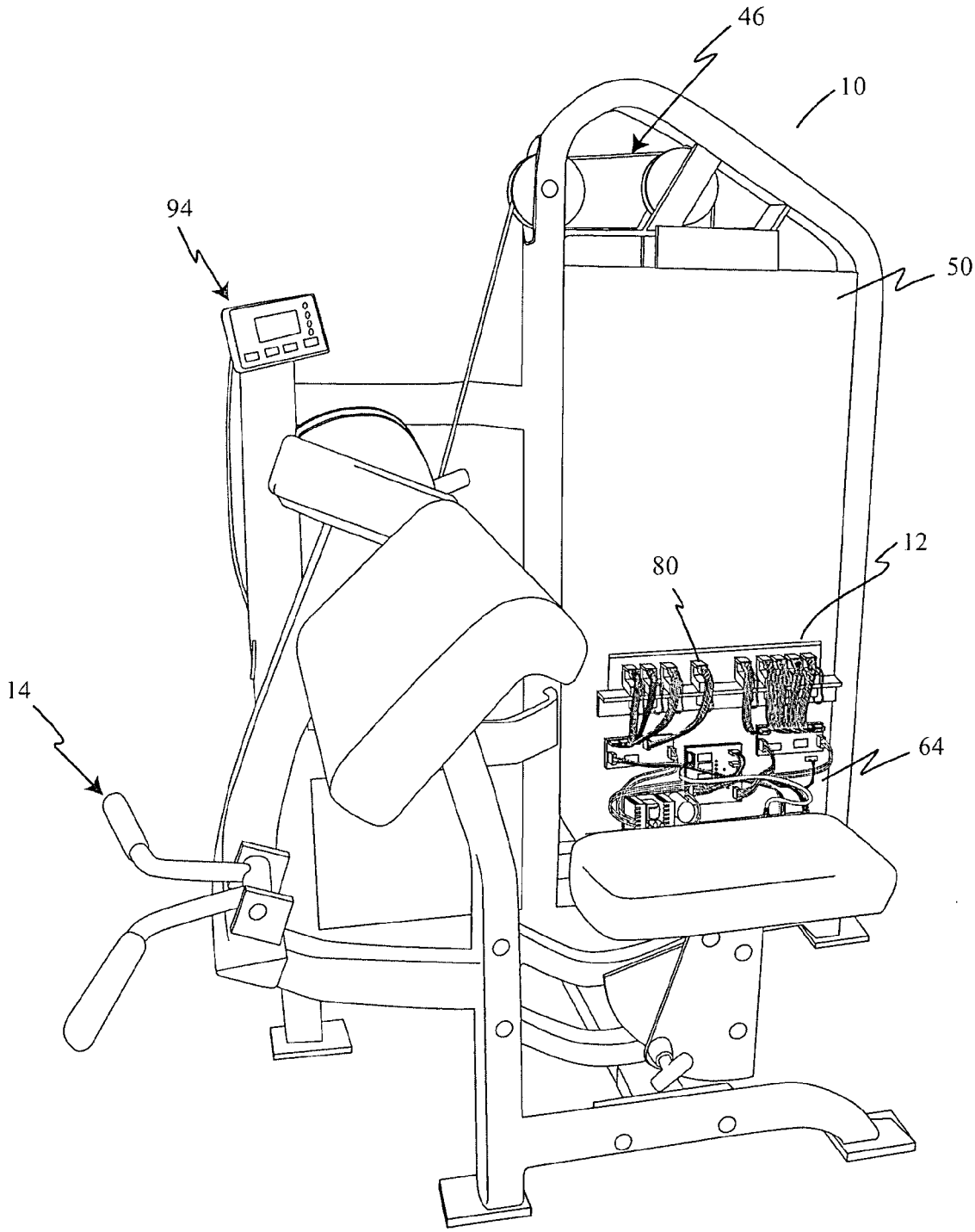
FIG. 2 is a front perspective view of the exercise machine of FIG. 1.

As illustrated in FIGS. 1 and 2, an exercise machine, generally designated 10, is provided with a variable resistance system 12. Variable resistance system 12 of the present invention is designed for use in connection with numerous types of exercise machines 10, both known and those that may yet be developed. For example, FIGS. 1 and 2 show a conventional exercise machine 10 for a bicep curl having a manually operable member 14 that a user grasps and moves against resistance. Although the variable resistance system 12 of the present invention is only shown as used with an exercise machine 10 for "bicep curl" exercises, variable resistance system 12 can be used to provide resistance for many types of exercise machines 10, which are utilized for many different types of exercises, including, for example, bench press, butterfly, cable cross over, lateral pull down, pull-up/dip assist, abdominal crunch, leg press, leg extension and squat type machines. These examples are provided for illustration purposes and are not intended to be limiting; variable resistance system 12 of the present invention can be used to provide resistance for virtually any type of exercise. Furthermore, variable resistance system 12 can be used to retrofit exercise machines 10 that originally used other sources of resistance, or can alternatively be built directly into new exercise machines 10.

Figure 3:
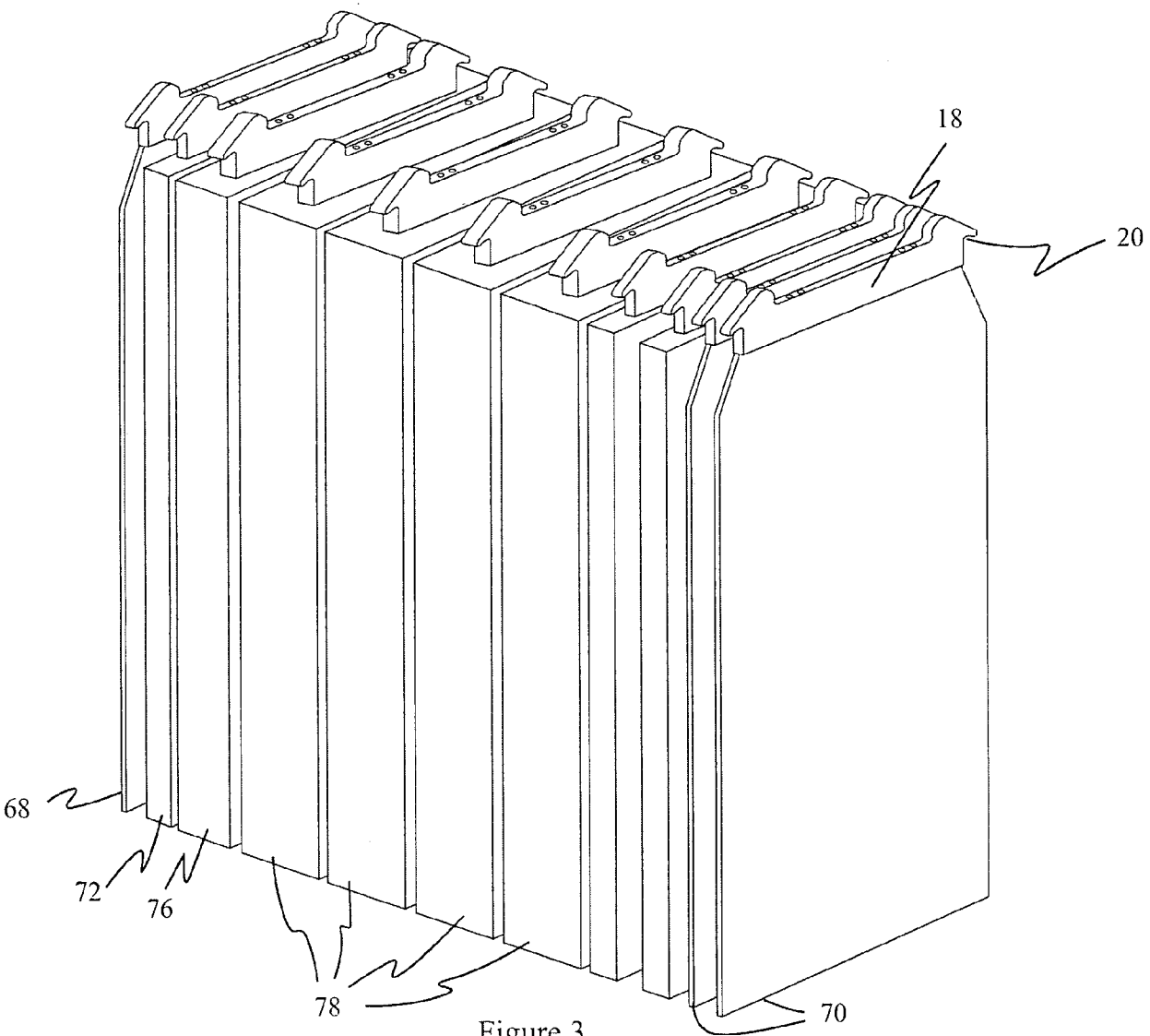
FIG. 3 is an upper perspective view of a weight stack for a variable resistance system constructed in accordance with the present invention.
Figure 4B:
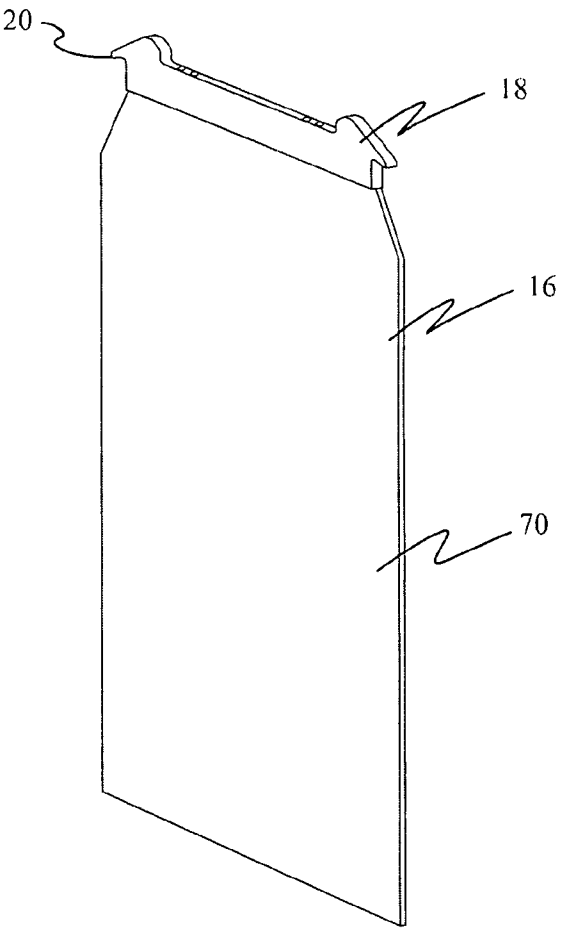
FIG. 4B is an elevational view of another type of weight from the weight stack of FIG. 3.
Figure 4A:
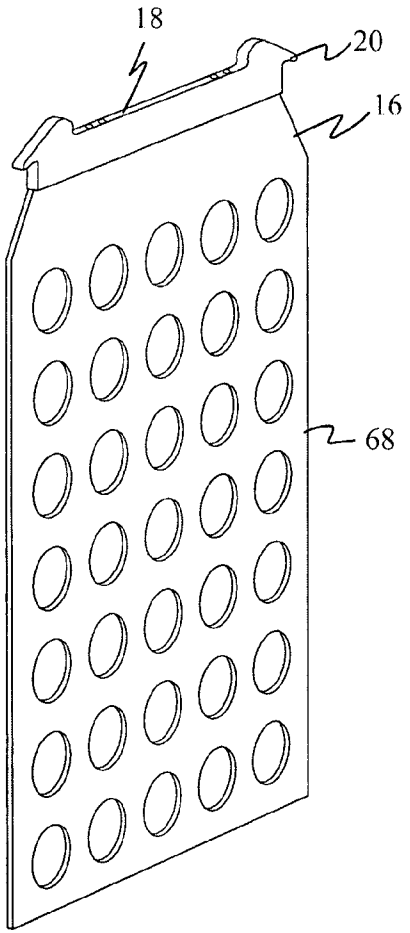
FIG. 4A is an elevational view of one type of weight from the weight stack of FIG. 3.
Figure 6:
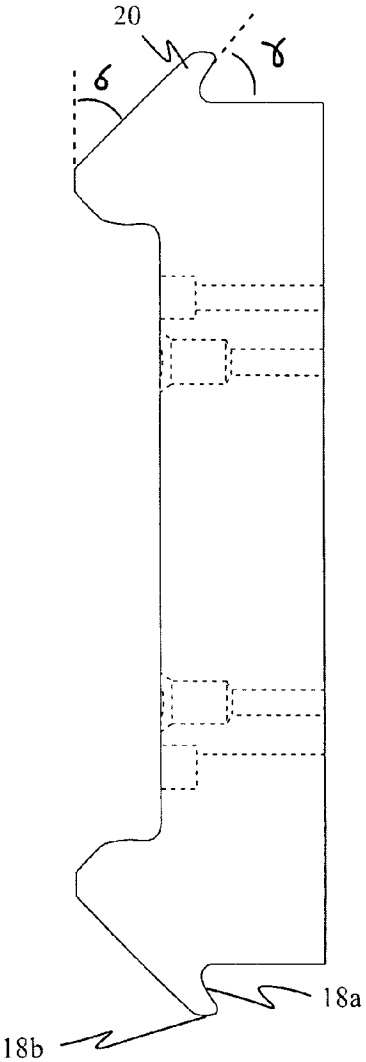
FIG. 6 is a side elevational view of the weight hook of FIG. 5.

According to a preferred embodiment of the present invention, variable resistance system 12 includes a series of vertically oriented weight plates 16 (illustrated individually in FIGS. 4A and 4B), which are best shown in FIG. 3 as being disposed in variable resistance system 12 side-by-side, as if "stacked" horizontally relative to each other. However, the present invention is not limited to vertically oriented weights, and may be used with other forms of resistance providing members such as, by way of example, horizontally oriented weights, springs and elastic bands. Preferably, weight plates 16 have a weight hook 18 fixed to an upper portion of each weight plate 16. Weight hooks 18 may be fixed to weight plates 16 by various means such as, for example, screws. FIGS. 5 and 6 show a weight hook 18 detached from a weight plate 16 and in detail. Each weight hook 18 preferably has a downward facing hook portion 20 on each end.

Weight hooks 18 are selectively engaged by selector hook assemblies 22; one such selector hook assembly 22 is illustrated in FIGS. 7A and 7B. Selector hook assembly 22 preferably comprises a first selector hook 24, a crossbar 28 and a second selector hook 26. Each selector hook 24, 26 preferably has a bearing 30 passing through it, where a bearing 30 is above the relevant connection with the crossbar 28 in the first selector hook 24 and below the connection with the crossbar 28 in the second selector hook 26. First selector hook 24 preferably has a selector magnet 32 fixed to its outer edge below the connection to crossbar 28.

Multiple selector hook assemblies 22 are preferably attached to a lift plate 34, as best shown in FIGS. 8-10. Pairs of brackets 36 are preferably mounted on the lift plate 34 and have two shafts fixed between them, which respectively pass through the bearings 30 on the first and second selector hooks 24, 26 of each selector hook assembly 22. According to the preferred embodiment, each pair of brackets 36 may support only one selector hook assembly 22, or may support multiple selector hook assemblies 22. If a single pair of brackets 36 supports multiple selector hook assemblies 22, spacers 38 may be necessary to properly position the respective selector hook assemblies 22, horizontally, relative to adjacent assemblies 22.

In operation of the preferred embodiment, one selector hook assembly 22 is provided for each weight plate 16, and the selector hook assemblies 22 selectively engage weight hooks 18. One actuator magnet 40 is preferably provided for each selector hook assembly 22, and each selector hook assembly 22 is preferably actuated by its respective actuator magnet 40. Actuator magnets 40 are preferably physically separate from lift plate 34 selector hook assemblies 22, and are discussed in greater detail below. The use of magnetic forces to actuate selector hook assembly 22 permits movement of selector hook assembly 22 to be dissociated from the position of an actuator assembly 80, which is discussed in detail below, which means that selector hook assembly 22 can freely move up and down without actuator assembly 80 moving with it, and without the need for physical components linking actuator assembly 80 with selector hook assembly 22.

Considering a single selector hook assembly 22 formed in accordance with the preferred embodiment, when an actuator magnet 40 does not exert an attractive force on its respective selector magnet 24, or alternatively when an actuator magnet 40 exerts a repulsive force on its respective selector magnet 24, the first and second selector hooks 24, 26 are drawn towards their respective weight hook 18 by gravity and/or the repulsive force of the actuator magnet 40, such that when selector hook assembly 22 is drawn upward by lift plate 34, selector hooks 24, 26 will engage their respective weight hook 18, pulling it upward as well, together with their respective weight plate 16.

Conversely, when actuator magnet 40 exerts an attractive force on selector magnet 32 the bottom portion of the first selector hook 24 is preferably drawn away from its respective weight hook 18. Considering the configuration and orientation of selector assembly 22 presented in FIGS. 7 and 7A, and considering that both selector hooks 24, 26 rotate about their respective bearing 30, when the bottom portion of first selector hook 24 is pulled away from the respective weight hook 18, which is towards the left in FIG. 7, the crossbar 28 is also pulled towards the left, which results in a counterclockwise rotation of the second selector hook 26 about its bearing 30, thereby drawing the bottom portion of the second selector hook 26 away from the respective weight hook 28 as well. Accordingly, in the embodiment shown, when actuator magnet 40 exerts an attractive force on selector magnet 32, both selector hooks 24, 26 are preferably drawn away from their respective weight hook 18, such that when selector hook assembly 22 is drawn upward, together with lift plate 34, selector hooks 24, 26 will not engage their respective weight hook 18, and the respective weight plate 16 will not be pulled upward (as a portion of the weight resistance) with lift plate 34. In this manner, the mechanism for selecting weight plates to be lifted in the preferred embodiment requires neither springs nor pins.

According to the preferred embodiment, when lift plate 34 is lowered and nears its lowest position (the "home" position discussed below), the outer surface of each selector hook 24, 26 will tend to slide over the outer surface of each weight hook 18 because both surfaces are provided at an angle tending to press the selector hooks 24, 26 outward. However, once the tip of the selector hook 24*b*, 26*b* passes below the tip of the weight hook 18*b*, the selector hooks 24, 26 will fall back inward, unless acted on by an attractive force between selector magnet 32 and actuator magnet 40 so as to prevent engagement of weight hook 18 by selector hooks 24, 26, as discussed above. Once selector hooks 24, 26 have fallen back inward, when lift plate 34 is raised the inner surface of selector hooks 24, 26 will engage inner surface of weight hooks.

Thus, the inner angle $\alpha$ of selector hooks 24, 26 (shown in FIG. 7A) and the inner angle $\gamma$ of weight hooks 18 (shown in FIG. 6) are preferably selected such that the engagement of selector hooks 24, 26 and weight hooks 18 is secured by the weight of weight plate 16. That is to say, when selector hooks 24, 26 are engaged with weight hooks 18, the inner angles $\alpha$, $\gamma$ are small enough that the weight of weight plate 16 causes an inner surface of selector hooks 24*a*, 26*a* at angle $\alpha$ to interact with an inner surface of weight hooks 18*a* at angle $\gamma$, such that selector hooks 24, 26 have a tendency to rotate towards weight hooks 18, thereby securing the engagement while weight plate 16 is being lifted. The inner angles $\alpha$ and $\gamma$ must also be large enough such that, when actuated to do so, selector hooks 24, 26 will disengage from weight hooks 18; that is to say the outer tip of selector hooks 24*b*, 26*b* must clear the outer tip of weight hooks 18*b* when the lift plate is in home position and selector hooks 24, 26 are rotated away from weight hooks 18. The outer angle $\beta$ of selector hooks 24, 26 (shown in FIG. 7A) and the outer angle $\delta$ of weight hooks 18 (shown in FIG. 6) are preferably selected such that selector hooks 24, 26 traveling downward towards a stationary weight hook 18 are forced open to allow selector hooks 24, 26 to slide over weight hooks 18. According to the preferred embodiment, $\alpha$ is approximately 72°, $\beta$ is approximately 55°, $\gamma$ is approximately 60°, and $\delta$ is approximately 45°.

Lift plate 34 is preferably pulled upward by a cable 46 or other lifting member, such as a belt, that is ultimately driven by manually operable member(s) 14 being moved by a user. According to the preferred embodiment, and as best shown in FIG. 10, lift plate 34 is guided by a set of guide wheels 48 on two opposing sides of the lift plate 34. Guide wheels 48 preferably act against a housing 50 so that lift plate 34 is substantially restrained from shifting in the horizontal plane during movement and thus facilitates extremely quiet operation of system 12.

In the depicted embodiment, when the lift plate 34 is in its lowest position the selector hooks 24, 26 are able to engage or disengage their respective weight hooks 18. Lift plate 34 is preferably able to travel a small distance above its lowest position and still allow selector hooks 24, 26 to engage or disengage their respective weight hooks 18. This vertical distance is very limited to prevent injury to the user and damage to variable resistance system 12; in a preferred embodiment, this vertical distance is approximately 0.125 inches. The limited vertical range of lift plate 34 in which selector hooks 24, 26 are able to engage or disengage their respective weight hooks 18, including the lowest position of lift plate 34, is considered the "home" position of the lift plate 34.

A sensor is preferably incorporated into the variable resistance system 12 that facilitates monitoring of the vertical movement of the lift plate 34. According to the preferred embodiment, lift plate 34 is connected to a timing belt 52, which can be seen within the system housing in FIG. 1. Timing belt 52 is preferably connected to and between two pulleys 54, 56, an upper pulley 54 near the top of the potential of vertical travel of lift plate 34, and a lower pulley 56 near the bottom of the potential vertical travel of lift plate 34. In the preferred embodiment, one of pulleys 54, 56 is connected to a slotted disk 58 that works in conjunction with an optical sensor 60, in known manner, to determine the vertical movement of the lift plate 34, as shown in FIG. 11. Slotted disk 58 preferably has seventy-two slots 62 disposed at five degree increments near its circumference. Optical sensor 60 preferably senses each time a slot 62 passes, and sends a signal corresponding to each passing slot to controller 64, which is discussed in greater detail below. In this manner, the rotation of pulley 54, 56 to which slotted disk 58 is attached can be sensed, and thus the vertical movement of lift plate 34 can be derived.

As best seen in FIG. 12, weight plates 16 that are not engaged by the selector hook assemblies 22 and, therefore, not pulled upward with the lift plate 34, are preferably seated in positioning grooves 66 in the base of the variable resistance system 12 so that such weight plates 16 remain appropriately positioned during movement of the lift plate 34. Preferably, the uppermost portion of these positioning grooves 66 are tapered such that relatively minor shifts in the weight plates 16 that may occur while being lifted are automatically corrected when the weight plates 16 are returned to a resting position.

According to the embodiment illustrated in FIG. 12, the series of weight plates 16 is selected to allow one pound increments of weight resistance increase or decrease. This embodiment incorporates one one-pound-plate 68, two two-pound-plates 70, one five-pound-plate 72, two ten-pound-plates 74, one twenty-seven-pound-plate 76, and two fifty-four-pound-plates 78. It should be appreciated that numerous combinations of weight plates 16 may be used to provide desired minimum increments and maximum weight. Of course, other combinations of weights for the multiple weight plates in the system may be utilized successfully.

Thus, according to the preferred embodiment, by selectively applying an attractive force between actuator magnets 40 and selector magnets 32, variable resistance system 12 can selectively cause desired weight plates 16 to be pulled upward with lift plate 34, while leaving the other weight plates 16 in place.

According to the preferred embodiment, actuator magnets 40 have two poles. When a first pole faces selector magnet 32 a repulsive force acts on selector magnet 32, and when a second pole faces selector magnet 32 an attractive force acts on selector magnet 32. The actuator magnets 40 are preferably controlled by actuator assemblies 80, as illustrated in FIGS. 13A, 13B and 13C. Actuator assemblies 80 preferably include a motor 82, a gear box 84, a magnet sleeve 86 containing actuator magnet 40, an orientation disk 88 and an optical sensor 90. Motor 82 is preferably controlled by a controller 64, which is discussed in detail below. In operation of the preferred embodiment, when actuation of the actuator magnet 40 is desired, controller 64 causes a current to pass through the armature of motor 82, causing shaft 92 of motor 82 to rotate. Gear box 84 preferably reduces the rotation speed of motor shaft 92 and transmits the rotation to magnet sleeve 86 containing actuator magnet 40.

Actuator magnet 40 is preferably rotated between an attractive orientation, in which actuator magnet 40 exerts an attractive force on selector magnet 32, and a repulsive orientation, in which actuator magnet 40 exerts a repulsive force on selector magnet 32. To switch between the attractive orientation and the repulsive orientation, actuator magnet 40 is rotated approximately one hundred and eighty degrees. Orientation disk 88 rotates with magnet sleeve 86 and has two slots. One slot is aligned with the attractive orientation, and the other slot is aligned with the repulsive orientation. In the preferred embodiment, optical sensor 90 senses the slots of the orientation disk 88 and provides a signal to the controller 64 corresponding to the presence or absence of a slot. In this manner controller 64 is able to more precisely control the orientation of actuator magnet 40, based on the signal provided by optical sensor 90. That is to say optical sensor 90 and the orientation disk 88 help controller 64 to more precisely rotate the actuator magnet 40 in order to switch from a repulsive orientation to an attractive orientation and vice versa.

Controller 64 and actuator assemblies 80 of the preferred embodiment are illustrated in FIG. 14; however, in a commercial embodiment of the present invention, this portion of the apparatus would be covered from view and access by the consumer or user (for example by a solid metal plate), for safety. Controller 64 preferably receives input signals from both the optical sensors 90 on actuator assemblies 80 and optical sensor 60 on upper or lower pulley 54, 56, and transmits this data to a user interface console 94, which is discussed in greater detail below. Controller 64 also preferably receives command instructions from user interface console 94 and aligns the individual actuator magnets 40 to repulsive or attractive orientations according to such command instructions.

User interface console 94 of the preferred embodiment is illustrated in FIG. 15 and preferably has four buttons 96, an LCD display 98 and four LED's 100, although other arrangements on the console can be imagined that will suffice. User interface console 94 is preferably attached to exercise machine 10 at a location providing convenient access to a user without requiring the user to move from use position in order to see and readily access the console.

According to the preferred embodiment, prior to exercising a user inputs various values into the user interface to customize his or her exercise. A given variable resistance system 12 may incorporate any number of different types of inputs.

Variable resistance system 12 of the preferred embodiment has two user inputs: intensity level and starting weight. According to this embodiment, the user selects a starting weight and an intensity level ranging from one to ten, or alternatively the user may select manual. Once the user enters a starting weight, the variable resistance system selects among weight plates 16 such that the total resistance is equal to the selected starting weight. If no starting weight is entered, a default starting weight is preferably automatically selected.

According to the preferred embodiment, variable resistance system 12 selects a given weight by user interface console 94 communicating to the controller 64 which weight plates 16 are to be selected, and controller 64 causes actuating magnets 40 to rotate into the orientation appropriate to cause selector hooks 24, 26 to engage weight hooks 18 for each weight plate 16 that is to be lifted. Conversely, controller 64 causes actuating magnets 40 to rotate into the orientation that causes selector hooks 24, 26 to not engage weight hooks 18 for each weight plate 16 that is not to be lifted.

According to the preferred embodiment, when the user begins exercising, controller 64 monitors the vertical travel of lift plate 34, as described above. On the first repetition, the maximum vertical travel of lift plate 34 is preferably recorded as the user's maximum range. If lift plate 34 is lifted higher on a subsequent repetition, the user's maximum range is preferably reset to the new, higher value. In the preferred embodiment, each repetition in which lift plate 34 is lifted to or above a given percentage of the maximum range is considered a successful repetition. The percentage of the maximum range necessary to constitute a successful repetition can be set at any reasonable value; however, the percentage is preferably in the range of eighty to ninety-five percent.

According to the preferred embodiment, when a successful repetition is achieved, the uppermost LED 100 on user interface console 94 automatically turns on and user interface console 94 preferably makes an audible beep. The illuminated uppermost LED 100 and the audible beep indicate to a user that he or she has achieved a successful repetition. Clearly, the system will operate successfully without the presence of the audible beep, and even without any visual indication that the presence or absence of an audible beep or other indicator of a successful repetition, as the automatic adjustment in resistance level will be altered regardless of any indicator of the required critera.

After each successful repetition, the total weight (resistance) lifted is incrementally increased, preferably at any preselected reasonable value. In the preferred embodiment the incremental increase in weight is approximately five percent. That is to say, after each successful repetition, a new weight is calculated that is approximately five percent greater than the weight lifted in the last successful repetition. The weight that is actually lifted can be rounded down to the nearest available value.

According to the preferred embodiment, on a given repetition when a user does not raise lift plate 34 to the percentage of the maximum range necessary to constitute a successful repetition, such repetition is considered a "failed" repetition. After a failed repetition, the weight lifted is incrementally decreased, as determined on the basis of the intensity level pre-selected by the user. The incremental decrease and increase in weight utilized in the preferred embodiment are set forth in Table 1 below.

TABLE 1

Incremental decrease and increase of resistance.

| Intensity Level | Weight Decrement (%) | Weight Increment (%) |
|---|---|---|
| Manual | 0 | 0 |
| 1 | 60 | 5 |
| 2 | 55 | 5 |
| 3 | 50 | 5 |
| 4 | 45 | 5 |
| 5 | 40 | 5 |
| 6 | 35 | 5 |
| 7 | 30 | 5 |
| 8 | 25 | 5 |
| 9 | 20 | 5 |
| 10 | 15 | 5 |

As shown in Table 1, if a user selects manual mode, the weight lifted with the lift plate is neither automatically increased nor decreased, regardless of the status of the repetition. If manual mode is chosen, a user must manually select a different weight value on the user interface console 94 if he or she desires a different amount of weight.

According to the preferred embodiment, variable resistance system 12 is able to determine whether a repetition is a success or a failure once the vertical travel of lift plate 34 reaches a peak, that is to say when the vertical travel of the lift plate changes from upward to downward. At this point variable resistance system 12 is preferably able to calculate the amount of weight to be lifted on the next repetition almost instantaneously. Thus, at the point in time directly after the vertical travel of lift plate 34 has peaked, user interface console 94 preferably communicates which weight plates 16 are to be lifted and which weight plates 16 are not to be lifted to controller 64, and controller 64 causes the appropriate actuating magnets to rotate 40 accordingly. Thus, all actuating magnets 40 are preferably each properly oriented for the next repetition well before lift plate 34 returns to a home position. In this manner as soon as lift plate 34 is in the home position, the appropriate selector hooks will engage or disengage their respective weight hooks 18.

According to the preferred embodiment an optional memory card 102 is available for users to store information related to prior exercise. User interface console 94 preferably has an interface in which a user may insert memory card 102. According to this embodiment, memory card 102 automatically provides all applicable user input values to the user interface, so that the user only needs to insert his or her card, and does not need to remember or manually input any values, unless he or she wishes to deviate from the information stored on memory card 102. Such memory cards 102 can also be designed so that they are capable of interfacing with a personal computer, on which information related to a user's exercise history and/or routine may be viewed and/or manipulated. In this manner the exercise history of a user can be tracked and/or compared with various indicia of personal fitness such as, for example, the user's waist to hip ratio.

According to the preferred embodiment of the invention, a user can use either a memory card 102 having eight kilobytes of memory or a memory card 102 having thirty-two kilobytes of memory. The memory on the eight kilobyte memory card 102 and the thirty-two kilobyte memory card 102 are preferably organized as shown in Tables 2 and 3 below. For both types of memory cards 102, a small portion of the memory reserved for machines and exercises is left available for further categories of data that a user may desire to store.

TABLE 2

Preferable organization of a eight kilobyte memory card.

| Area | Quantity Detail | Bytes | Total |
|---|---|---|---|
| Card ID | 1 | | |
| | ID | 16 | 16 |
| Personal | 1 | | |
| | Type | 1 | |
| | User Id | 1 | |
| | Name | 59 | |
| | Total | | 64 |
| Machines | 64 | | |
| | Date | 4 | |
| | Starting | 2 | |
| | Intensity | 1 | |
| | Machine | 2 | |
| | Mode | 1 | |
| | Available | 2 | |
| | Total | | 12 |
| Exercises | 280 | | |
| | Date | 4 | |
| | Machine | 2 | |
| | Serial | 3 | |
| | Starting | 2 | |
| | Maximum | 2 | |
| | Total | 4 | |
| | Lifts | 2 | |
| | Trainer Id | 4 | |
| | Available | 3 | |
| | Total | | 26 |
| Total used | | | 8128 |

TABLE 3

Preferable organization of a thirty-two kilobyte memory card.

| Area | Quantity Detail | Bytes | Total |
|---|---|---|---|
| Card ID | 1 | | |
| | ID | 16 | 16 |
| Personal | 1 | | |
| | Type | 1 | |
| | User Id | 4 | |
| | Name | 59 | |
| | Total | | 64 |
| Machines | 64 | | |
| | Date | 4 | |
| | Starting | 2 | |
| | Intensity | 1 | |
| | Machine | 2 | |
| | Mode | 1 | |
| | Available | 2 | |
| | Total | | 12 |
| Exercises | 1200 | | |
| | Date | 4 | |
| | Machine | 2 | |
| | Serial | 3 | |
| | Starting | 2 | |
| | Maximum | 2 | |
| | Total | 4 | |
| | Lifts | 2 | |
| | Trainer Id | 4 | |
| | Available | 3 | |
| | Total | | 26 |
| Total used | | | 31984 |

As shown in Tables 2, the eight kilobyte memory card 102 preferably stores data related to sixty-four machines and two hundred and eighty exercises. As shown in Table 3, the thirty-two kilobyte memory card 102 preferably stores data related to sixty-four machines and one thousand two hundred exercises. In both cases, the information related to individual exercises is preferably stored in a manner such that the first exercise to be recorded will be the first exercise to be recorded over, once the exercise portion of the memory is full. It should be realized that the amount of memory, the medium in which information is stored, and the organization of the memory may all be modified to suit numerous exercise related purposes.

A more detailed explanation of the operation of user interface console 94 and memory card 102 before and during exercise according to a preferred embodiment of the present invention is set forth in flow charts provided in FIGS. 16-21.

In an alternative embodiment depicted in FIG. 22 of the present invention, the user interface console 94 is networked with a kiosk having a centralized personal computer and database, which may be networked with user interface consoles from other exercise equipment in the area. Such networking may be accomplished through the use of such data transmission mediums as Ethernet, serial ports, or other mediums of information transfer. The networking of the user interfaces of multiple pieces of equipment could be used in many different manners. By way of example, and not by way of limitation, a gym can maintain a centralized database containing extensive workout information of its members. This information may be used by members, personal trainers, therapists or others to optimize exercise routines. Alternatively, algorithms can also be developed to automatically provide useful information to members or personal trainers related to a user's exercise routine. User interface consoles 94 may also be connected to printers, either directly or through a networking personal computer, to provide users with a printed copy of their exercise results.

In yet another embodiment of the present invention variable resistance system 12 is self powered, for example, by converting energy expended by a user into electrical energy used to power variable resistance system 12.

As will now be understood, the present two-part selector-lift mechanism which separates the lift plate and selectors from the actuator switches provides increased reliability by eliminating the condition in which the body of an actuator pin gets stuck or sheared in the opening of a lifting bar, as is common in the prior art. This shear condition has prevented the known mechanisms in automatically adjustable exercise machines from being reliable enough to be successfully commercialized. With the pin-less condition of the selector lift mechanism separated from actuator switches made possible through adjacently opposed magnets, the present invention represents a truly reliable and viable method by which to finally commercialize automatically adjustable exercise machines and control systems therefor.

As various modifications could be made to the exemplary embodiments, as described above with reference to the corresponding illustrations, without departing from the scope of the invention, it is intended that all matter contained in the foregoing description and shown in the accompanying drawings shall be interpreted as illustrative rather than limiting. Thus, the breadth and scope of the present invention should not be limited by any of the above-described exemplary embodiments, but should be defined only in accordance with the following claims appended hereto and their equivalents. For example, it is foreseen that the presently described and claimed resistance system will also be useful as a part of other machines, besides exercise equipment, such as may be desired in a wide variety of industries.

What is claimed is:

1. A variable resistance system comprising:

a resistance providing member;

an actuator comprising a motor and an actuator magnet having a first pole and a second pole; and a selector assembly;

wherein the motor rotates the actuator magnet and the actuator causes the selector assembly to selectively engage or disengage the resistance providing member by applying or removing a force to or from the selector assembly; and wherein movement of the selector assembly is dissociated from the position of the actuator.

2. The variable resistance system of claim I wherein the force is selected from the group consisting of a magnetic force and a gravitational force.

3. The variable resistance system of claim I wherein the resistance providing member is comprised of a plurality of vertically oriented weight plates arranged in a side-by-side manner relative to each other.

4. The variable resistance system of claim 1, wherein the actuator further comprises a first sensor that senses the rotational position of the actuator magnet.

5. The variable resistance system of claim 1 wherein the resistance providing member comprises a resistance hook and the selector assembly comprises a selector hook and a selector magnet, the selector magnet having a first pole and a second pole.

6. The variable resistance system of claim 5 wherein:

the first pole of the selector magnet is attracted to the second pole of the actuator magnet; and the selector hook is actuated to selectively disengage from the resistance hook by the rotation of the actuator magnet to a first position characterized by the second pole of the actuator magnet substantially facing the first pole of the selector magnet.

7. The variable resistance system of claim 6 wherein the selector hook is actuated to selectively engage the resistance hook by the rotation of the actuator magnet to a second position characterized by the second pole of the actuator magnet not substantially facing the first pole of the selector magnet.

8. The variable resistance system of claim 7 wherein a force of gravity causes the selector hook to move into the second position.

9. The variable resistance system of claim 5 wherein the selector hook has an inner surface at an inner angle, the resistance hook has an inner surface at an inner angle, and interaction between the inner surface of the selector hook and the inner surface of the resistance hook causes the selector hook to rotate towards the resistance hook.

10. The variable resistance system of claim 9 wherein the inner angle of the selector hook is approximately seventy-two degrees and the inner angle of the weight hook is approximately sixty degrees.

11. The variable resistance system of claim 4 further comprising a second sensor that detects the position of the selector assembly.

12. The variable resistance system of claim 11 further comprising a controller that receives signals from the first sensor and the second sensor and controls the actuator.

13. The variable resistance system of claim 12 further comprising a user interface console that accepts input from a user and provides command instructions to the controller.

14. The variable resistance system of claim 13 wherein the user interface console comprises programmed logic that determines whether to engage/disengage the resistance providing member on the basis of information collected by the second sensor.

15. The variable resistance system of claim 13 further comprising a removable memory card that stores exercise related information.

16. An exercise device comprising:

an exercise machine; and a variable resistance system operatively connected to the exercise machine, wherein the variable resistance system comprises:

a resistance providing member comprising a resistance hook;

an actuator comprising:

a motor; and an actuator magnet having a first pole and a second pole;

wherein the motor rotates the actuator magnet;

a selector assembly comprising:

a selector magnet having a first pole and a second pole; and a selector hook;

a first sensor that senses the rotational position of the magnet; and a second sensor that senses the position of the resistance providing member;

wherein the actuator actuates the selector assembly to selectively engage or disengage the resistance providing member by applying or removing a force to or from the selector assembly; and wherein movement of the selector assembly is dissociated from the position of actuator.

17. The exercise device of claim 16 wherein:

the first pole of the selector magnet is attracted to the second pole of the actuator magnet;

the selector hook is actuated to selectively disengage from the resistance hook by rotation of the actuator magnet to a first position characterized by the second pole of the actuator magnet substantially facing the first pole of the selector magnet; and the selector hook is actuated to selectively engage the resistance hook by the rotation of the actuator magnet to a second position characterized by the second pole of the actuator magnet not substantially facing the first pole of the selector magnet.

18. The exercise device of claim 17, wherein the variable resistance system further comprises:

a controller that receives signals from the first sensor and the second sensor and controls the actuator;

a user interface console that accepts input from a user and provides command instructions to the controller, wherein the user interface console comprises programmed logic that determines whether to engage or disengage the resistance providing member on the basis of information collected by the second sensor.

19. An exercise machine comprising:

a resistance providing member having a rest position and a lift position;

a selector assembly connected to and moving with the resistance providing member between the rest position and the lift position, the selector assembly comprising a selector magnet having an engaged position and a disengaged position, wherein the engaged position corresponds with the selector assembly being engaged with the resistance providing member and the disengaged position corresponds with the selector assembly being disengaged from the resistance providing member; and an actuator assembly fixed relative to the rest position, the actuator assembly comprising a controller and an actuator magnet, wherein the controller causes the actuator magnet to apply a magnetic force to the selector magnet and move the selector magnet between the engaged position and the disengaged position.

20. The exercise device of claim 19 wherein the resistance providing member is comprised of a plurality of vertically oriented weight plates arranged in a side-by-side manner relative to each other and each of the plates has a weight hook, wherein the selector assembly is further comprised of a selector hook connected to the selector magnet, and wherein the actuator assembly is further comprised of a motor connected to the actuator magnet.

21. The exercise device of claim 19 wherein the resistance providing member is comprised of a plurality of weights moving between the rest position and the lift position, the selector assembly is further comprised of a plurality of selector magnets, and the actuator assembly is further comprised of a plurality of actuator magnets, wherein each of the actuator magnets corresponds with one of the selector magnets and one of the weights, and wherein a first combination of the weights are engaged according to the positions of the corresponding selector magnets as moved by the actuator magnets while the weights and selector magnets are in the rest position, the first combination of weights moving from the rest position to the lift position with the corresponding selector magnets while the actuator magnets remain at the rest position.

22. The exercise device of claim 21 wherein the actuator magnets attract the corresponding selector magnets to disengage their respective weights while the selector magnets and the weights are in the rest position.

23. An exercise machine comprising:

a resistance providing member comprising a plurality of weights moving from a rest position to a lift position;

a selector assembly attached to the resistance providing member, the selector assembly comprising a plurality of selector magnets corresponding with the plurality of weights, wherein each of the selector magnets can move from an engaged position to a disengaged position, the engaged position corresponding with the selector assembly being engaged with the weights and the disengaged position corresponding with the selector assembly being disengaged from the weights, wherein the selector assembly moves with the weights from the rest position to the lift position; and an actuator assembly fixed relative to the rest position, the actuator assembly comprising a controller and a plurality of actuator magnets, wherein the controller causes the actuator magnets to apply a magnetic force to the respective selector magnets to move the selector magnets between the engaged position and the disengaged position while the selector magnets are in the rest position.

24. An exercise machine comprising:

a plurality of resistance providing members, wherein at least one of the resistance providing members moves from a rest position to a lift position;

a selector assembly connected to and moving with at least one of the resistance providing members between the rest position and the lift position, and when in the rest position, the selector assembly comprising an engaged position and disengaged position, wherein the first position corresponds with the selector assembly being engaged with at least one of the resistance providing members and the second position corresponds with the selector assembly being disengaged from other resistance providing members; and an actuator assembly located at a fixed position proximate to the selector assembly at the rest position, wherein the actuator assembly applies a force to the selector assembly while the selector assembly is at the rest position and moves the selector assembly between the engaged position and the disengaged position, wherein the movement of the selector assembly between the rest position and the lift position is dissociated from the fixed position of the actuator assembly, the dissociated movement being without a connection between the actuator assembly with the selector assembly.

25. The exercise device of claim 24 wherein the resistance providing members are comprised of a plurality of vertically oriented weight plates arranged in a side-by-side manner relative to each other and each of the plates has a weight hook, wherein the selector assembly is comprised of a plurality of selector hooks connected to selector magnets, and wherein the actuator assembly is comprised of at least one controller and a plurality of actuator magnets, wherein the controller causes the actuator magnets to apply a magnetic force to the respective selector magnets to move the selector magnets between the engaged position and the disengaged position while the selector magnets are in the rest position, and wherein the selector hooks engage the weight hooks in the engaged position.

* * * * *